US012729086B2

(12) United States Patent
Okada

(10) Patent No.: US 12,729,086 B2
(45) Date of Patent: Sep. 8, 2026

(54) PAPER FEEDING DEVICE, PAPER FEEDING METHOD, RECORDING MEDIUM, AND IMAGE FORMING APPARATUS

(71) Applicant: Katsumi Okada, Kanagawa (JP)

(72) Inventor: Katsumi Okada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 118 days.

(21) Appl. No.: 18/925,655

(22) Filed: Oct. 24, 2024

(65) Prior Publication Data

US 2025/0153963 A1 May 15, 2025

(30) Foreign Application Priority Data

Nov. 15, 2023 (JP) ..... 2023-194739

(51) Int. Cl.
*B65H 19/10* (2006.01)
*B65H 16/10* (2006.01)
*B65H 26/06* (2006.01)

(52) U.S. Cl.
CPC ..... *B65H 19/10* (2013.01); *B65H 16/106* (2013.01); *B65H 26/063* (2013.01); *B65H 2511/16* (2013.01); *B65H 2801/03* (2013.01)

(58) Field of Classification Search
CPC ..... B65H 19/105; B65H 2301/41524; B65H 19/10; B65H 26/063
See application file for complete search history.

(56) References Cited

U.S. PATENT DOCUMENTS

| | | | | |
|---|---|---|---|---|
| 12,600,591 | B2 * | 4/2026 | Inoue | B65H 19/105 |
| 2021/0370693 | A1 | 12/2021 | Okada et al. | |
| 2021/0371227 | A1 | 12/2021 | Okada et al. | |
| 2022/0363504 | A1 | 11/2022 | Okada | |
| 2023/0264912 | A1 * | 8/2023 | Okada | B65H 19/105 |
| 2023/0271800 | A1 | 8/2023 | Okada et al. | |
| 2024/0116729 | A1 | 4/2024 | Iwasaki et al. | |

FOREIGN PATENT DOCUMENTS

| | | | |
|---|---|---|---|
| JP | S58-095061 | A | 6/1983 |
| JP | 2004-107080 | A | 4/2004 |
| JP | 2023-086451 | A | 6/2023 |
| JP | 2024-134018 | A | 10/2024 |

* cited by examiner

*Primary Examiner* — Jeremy R Severson
(74) *Attorney, Agent, or Firm* — Harness, Dickey & Pierce, P.L.C.

(57) ABSTRACT

A paper feeding device for rotating a roll paper forward and backward to feed the roll paper includes a roller, a sensor, a support, and processing circuitry. The sensor detects a level difference at an end of the roll paper. On the supports, the sensor and the roller are arranged at positions offset from each other in a circumferential direction of the roll paper with respect to a center of the roll paper. The support supports the sensor and the roller to abut on a surface of the roll paper. The processing circuitry controls rotation of the roll paper based on a sensor signal output from the sensor. The processing circuitry causes the roll paper to rotate in a paper feeding direction, and compares an inclination of a change in the sensor signal with a threshold value to detect a paper tube of the roll paper.

15 Claims, 32 Drawing Sheets

| SYMBOL | MEANING |
|---|---|
| R1 | SENSOR OUTPUT WHEN ROLL PAPER REAR END HAS PASSED BY SENSOR |
| R2 | SENSOR OUTPUT WHEN ROLL PAPER REAR END HAS PASSED BY ROLLING ELEMENT |

PAPER SURFACE STATE

PAPER TUBE_CARDBOARD
ON WHICH PAPER IS GLUED

PAPER TUBE_CARDBOARD
ON WHICH SEAL IS GLUED

PAPER TUBE_CARDBOARD
WITH LEVEL DIFFERENCE

PAPER FEEDING DEVICE, PAPER FEEDING METHOD, RECORDING MEDIUM, AND IMAGE FORMING APPARATUS

CROSS-REFERENCE TO RELATED APPLICATION

This patent application is based on and claims priority pursuant to 35 U.S.C. § 119(a) to Japanese Patent Application No. 2023-194739, filed on Nov. 15, 2023, in the Japan Patent Office, the entire disclosure of which is hereby incorporated by reference herein.

BACKGROUND

Technical Field

The present disclosure relates to a paper feeding device, a paper feeding method, a recording medium, and an image forming apparatus.

Related Art

A roll end detection technique for detecting a rear end (roll end) of a roll paper has been developed in a roll paper feeding device that feeds and conveys the roll paper. In addition, a technique has been developed in which a level difference between the roll paper and the paper tube at the time of being at a roll end is detected using a sensor capable of directly detecting the thickness of the roll paper, and the roll end is detected. Further, a technique has been proposed in which a roller is brought into contact with a surface of roll paper, and a rotation unevenness of the roller is detected by a sensor to detect the roll end, or the roll end is detected based on a change in a current value of a motor that drives the roller.

SUMMARY

The present disclosure described herein provides a paper feeding device for rotating a roll paper forward and backward to feed the roll paper. The paper feeding device includes a roller, a sensor, a support, and processing circuitry. The sensor detects a level difference at an end of the roll paper. On the supports, the sensor and the roller are arranged at positions offset from each other in a circumferential direction of the roll paper with respect to a center of the roll paper. The support supports the sensor and the roller to abut on a surface of the roll paper. The processing circuitry controls rotation of the roll paper based on a sensor signal output from the sensor. The processing circuitry causes the roll paper to rotate in a paper feeding direction, and compares an inclination of a change in the sensor signal with a threshold value to detect a paper tube of the roll paper.

The present disclosure described herein also provides an image forming apparatus that includes the paper feeding device.

The present disclosure described herein further provides a paper feeding method to be executed by a paper feeding device including: a conveyor to rotate a roll paper forward and backward to feed the roll paper; a roller; a sensor to detect a level difference at an end of the roll paper; and a support on which the sensor and the roller are arranged at positions offset from each other in a circumferential direction of the roll paper with respect to a center of the roll paper, the support supporting the sensor and the roller to abut on a surface of the roll paper. The paper feeding method includes controlling rotation of the roll paper based on a sensor signal output from the sensor, and causing the roll paper to rotate in a paper feeding direction and comparing an inclination of a change in the sensor signal with a threshold value to detect a paper tube of the roll paper.

The present disclosure described herein further provides a non-transitory recording medium storing program code. The program code causes a computer that controls a paper feeding device to perform a process. The paper feeding device includes: a conveyor that rotates a roll paper forward and backward to feed the roll paper; a roller; a sensor to detect a level difference at an end of the roll paper; and a support on which the sensor and the roller are arranged at positions offset from each other in a circumferential direction of the roll paper with respect to a center of the roll paper, the support supporting the sensor and the roller to abut on a surface of the roll paper. The process includes controlling rotation of the roll paper based on a sensor signal output from the sensor, and causing the roll paper to rotate in a paper feeding direction and comparing an inclination of a change in the sensor signal with a threshold value to detect a paper tube of the roll paper.

BRIEF DESCRIPTIONS OF THE DRAWINGS

A more complete appreciation of embodiments of the present disclosure and many of the attendant advantages and features thereof can be readily obtained and understood from the following detailed description with reference to the accompanying drawings, wherein.

Figure 13A:
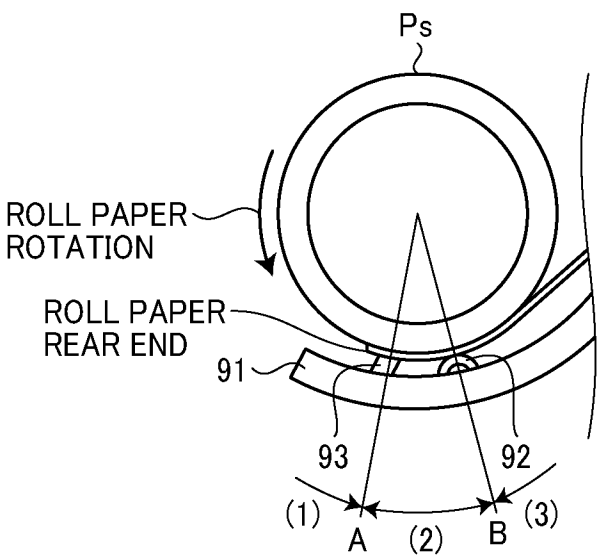
Figure 13B:
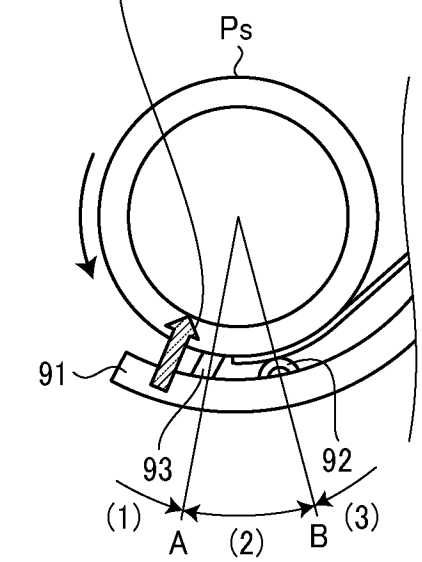
Figure 13C:
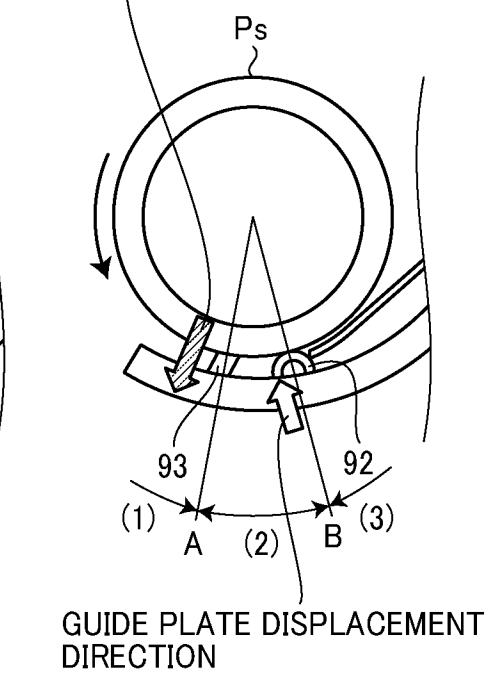
Figure 14:
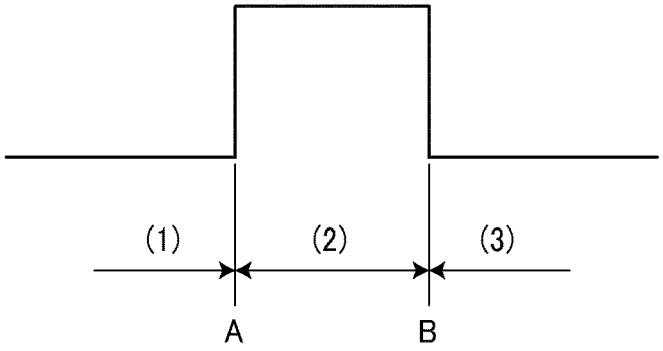
Figure 15:
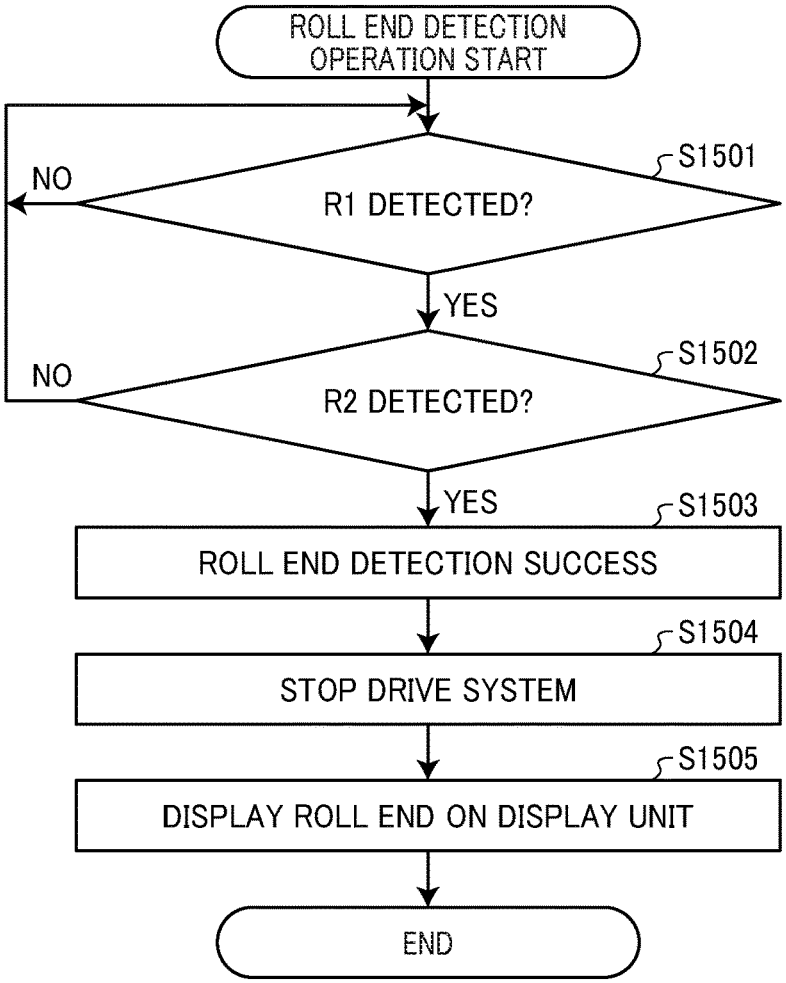
Figure 16:
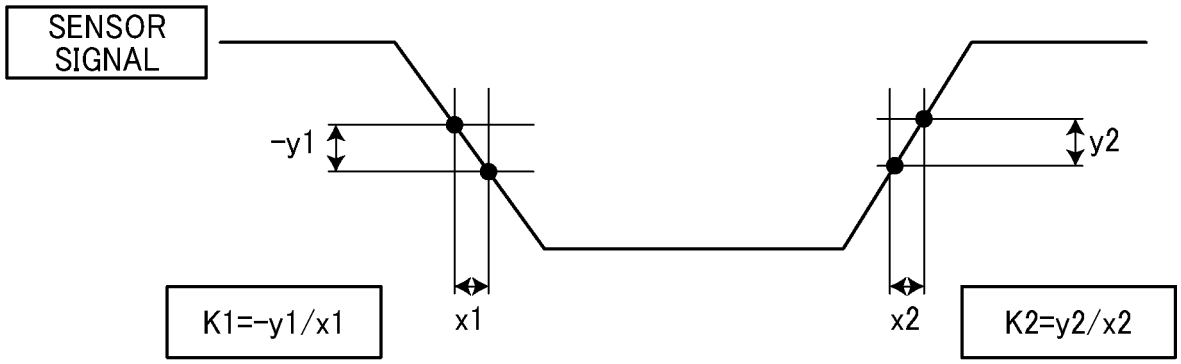
Figure 17:
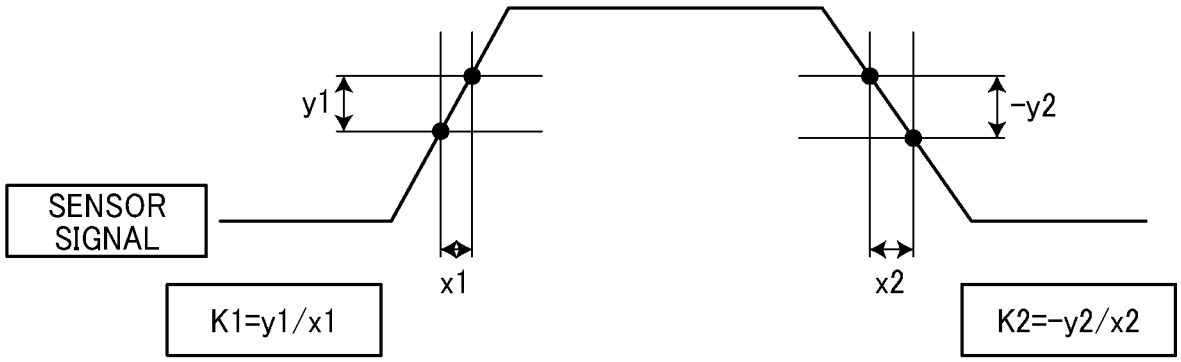
Figure 18:
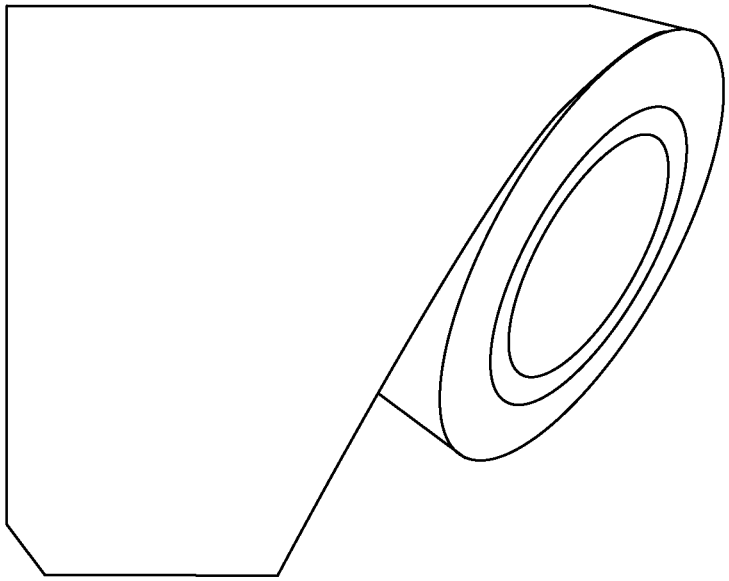
Figure 19:
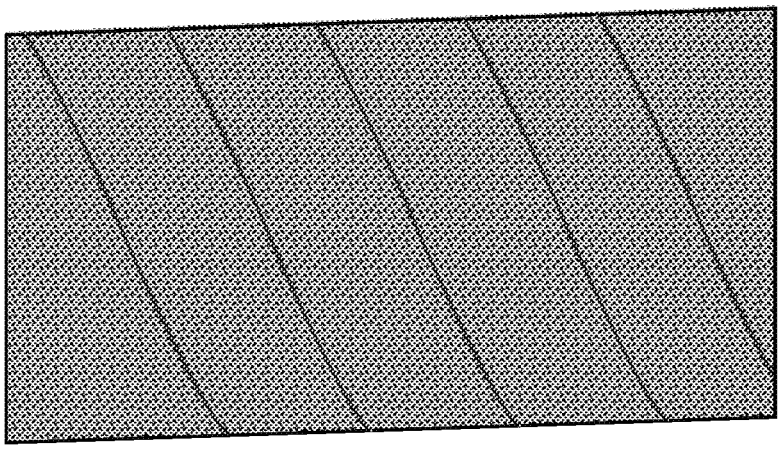
Figure 20:
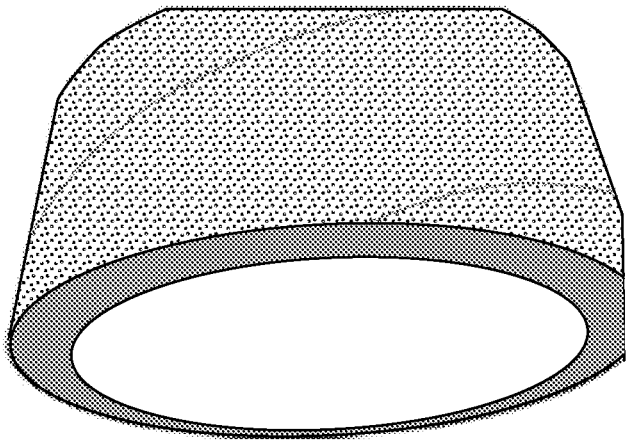
Figure 21:
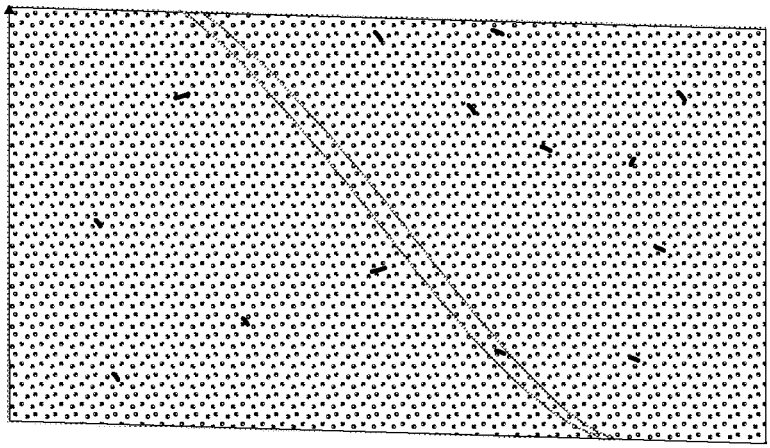
Figure 22:
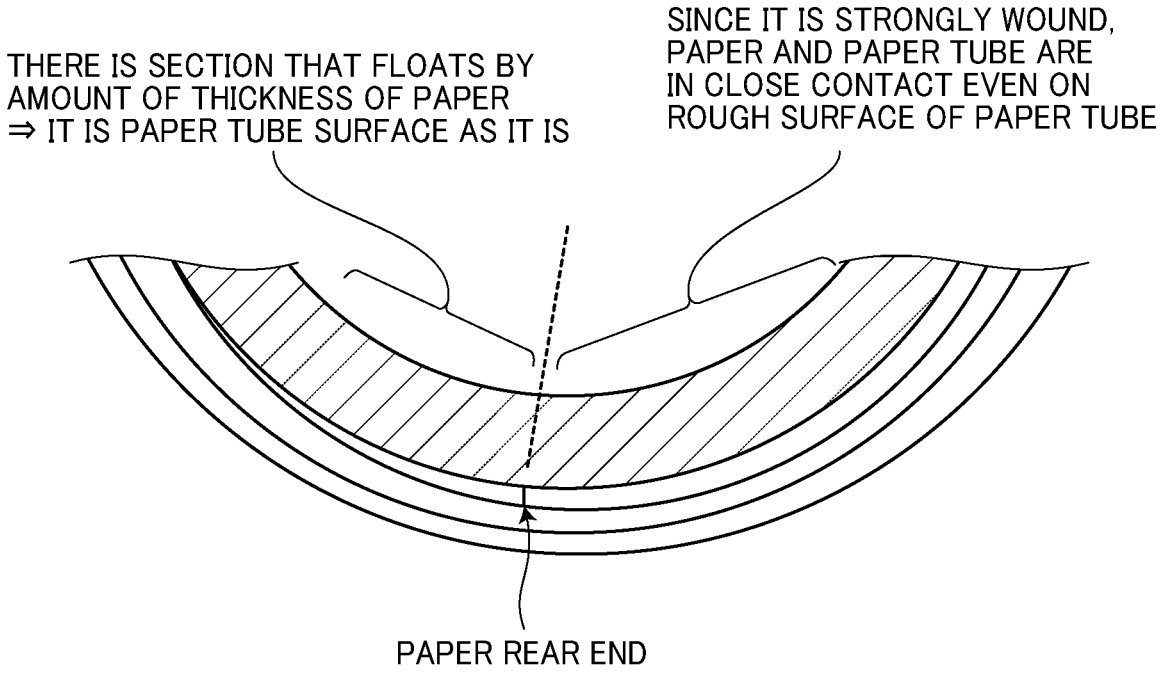
Figure 23A:
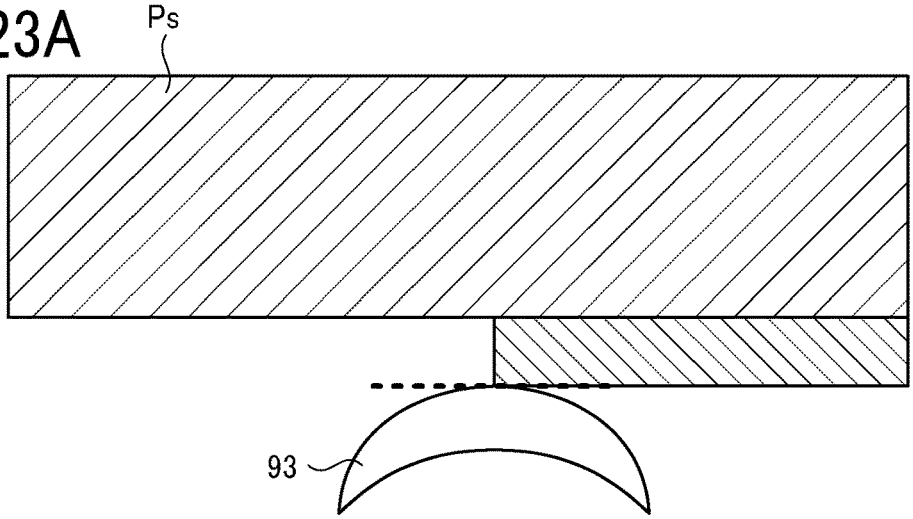
Figure 23B:
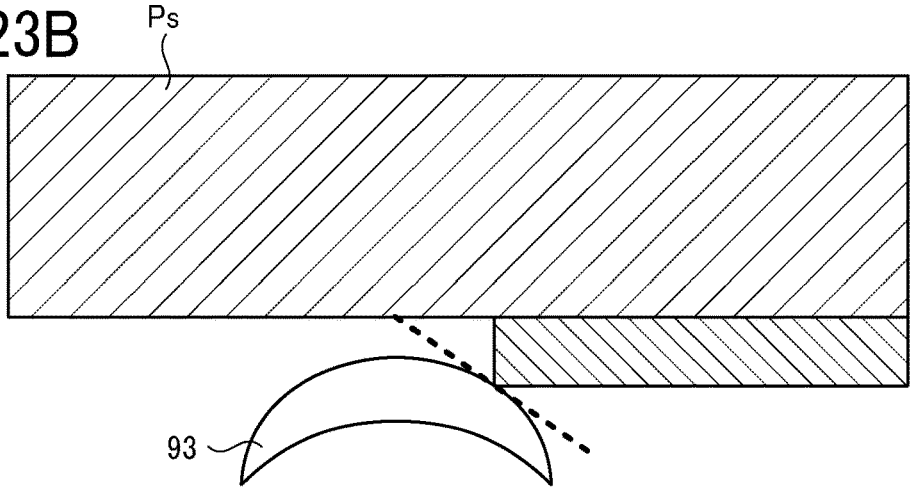
Figure 23C:
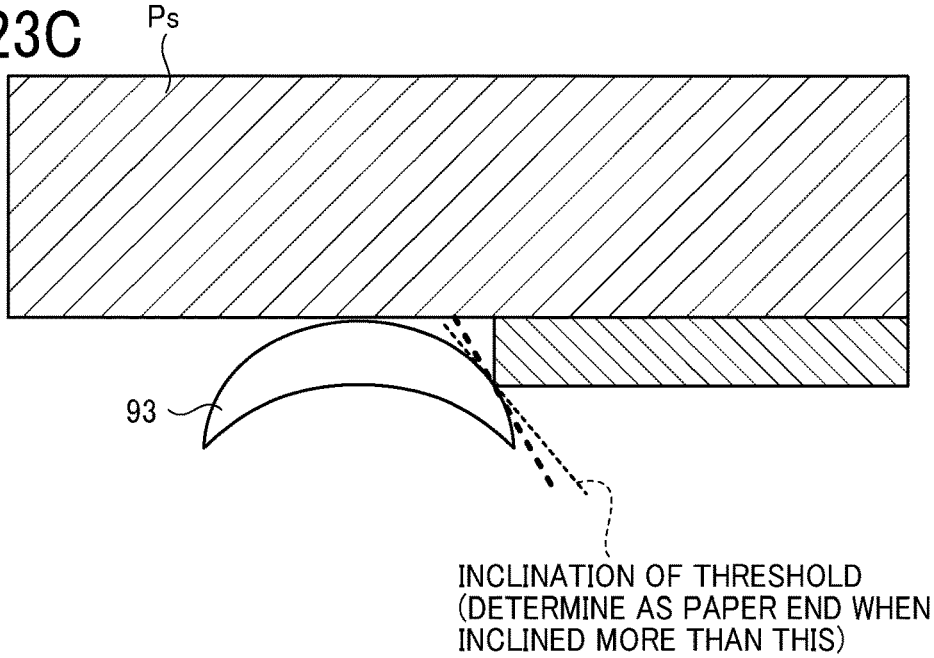
Figure 24:
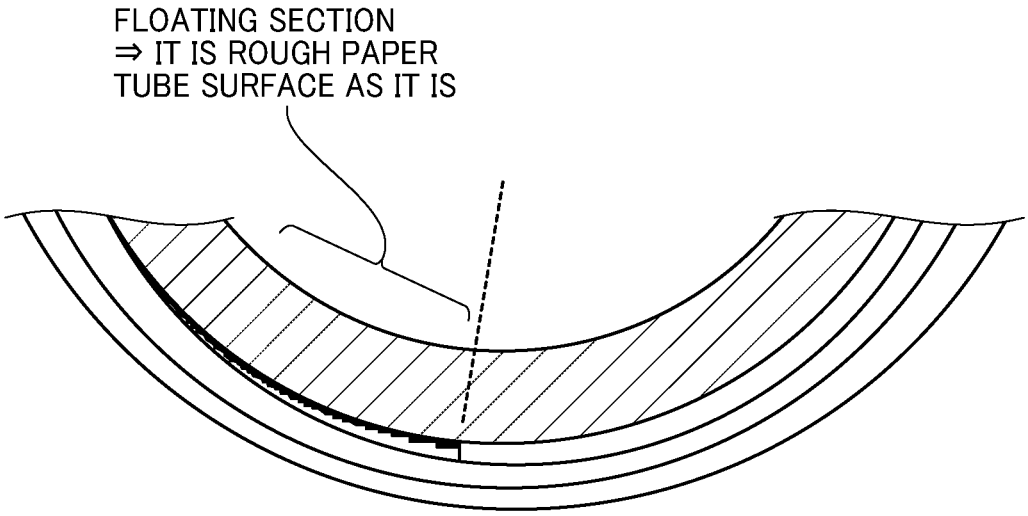
Figure 25A:
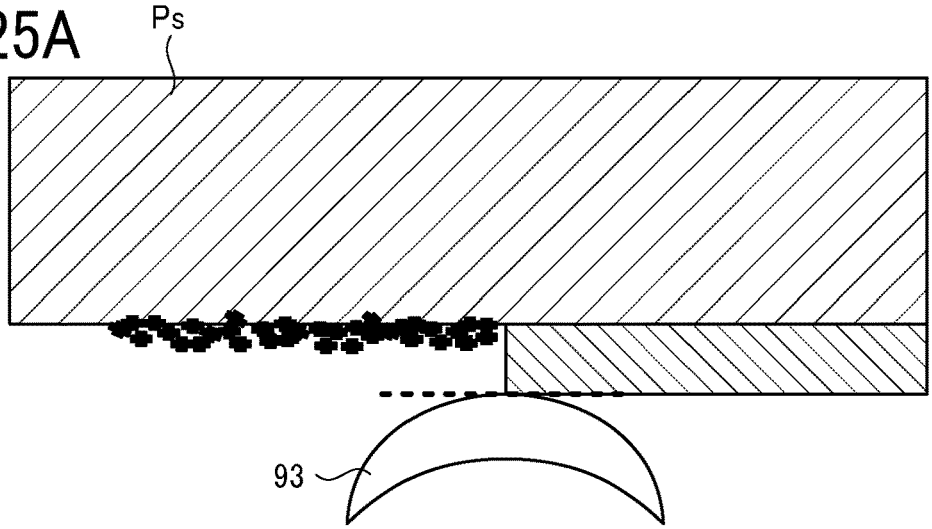
Figure 25B:
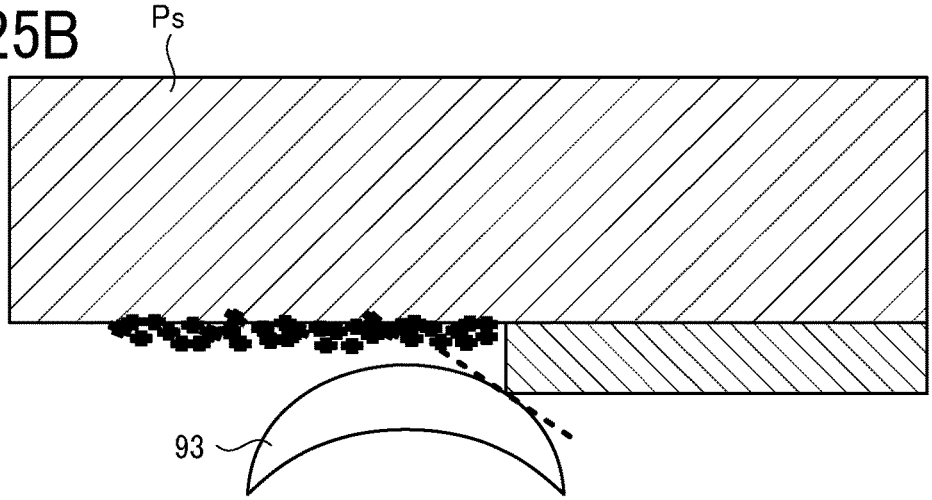
Figure 25C:
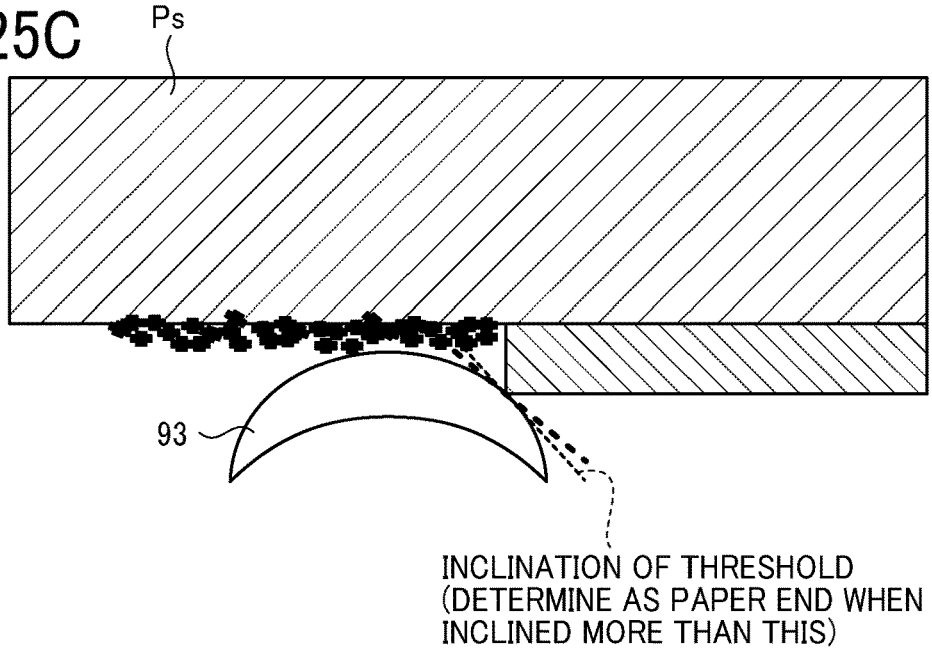
Figure 26:
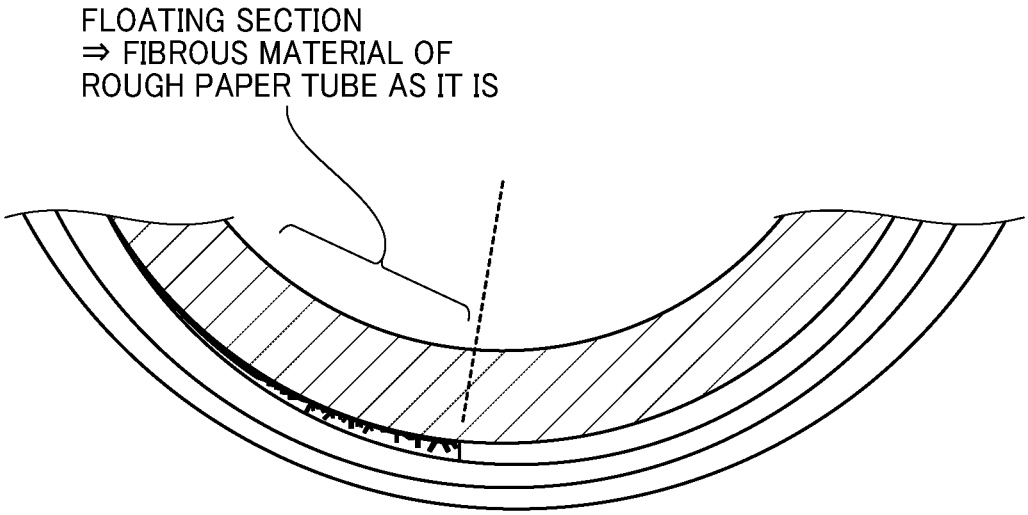
Figure 27A:
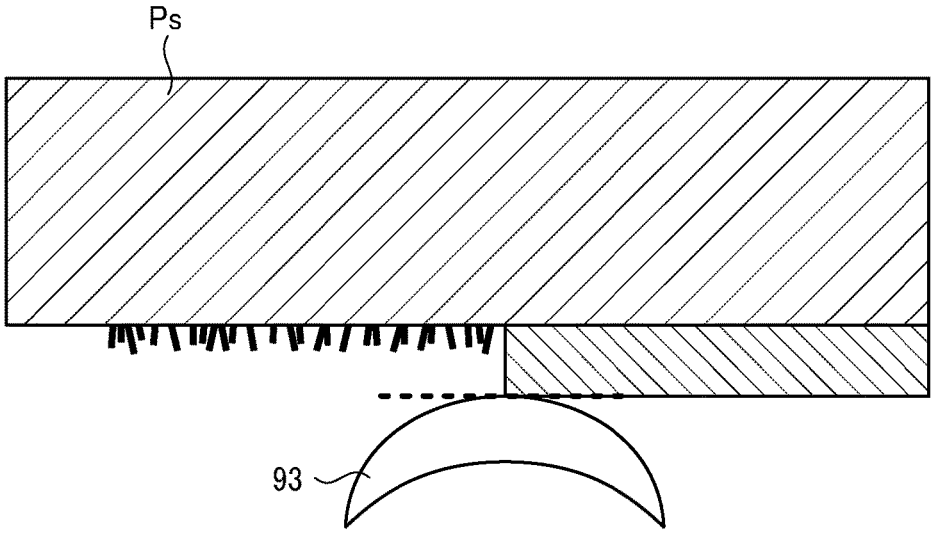
Figure 27B:
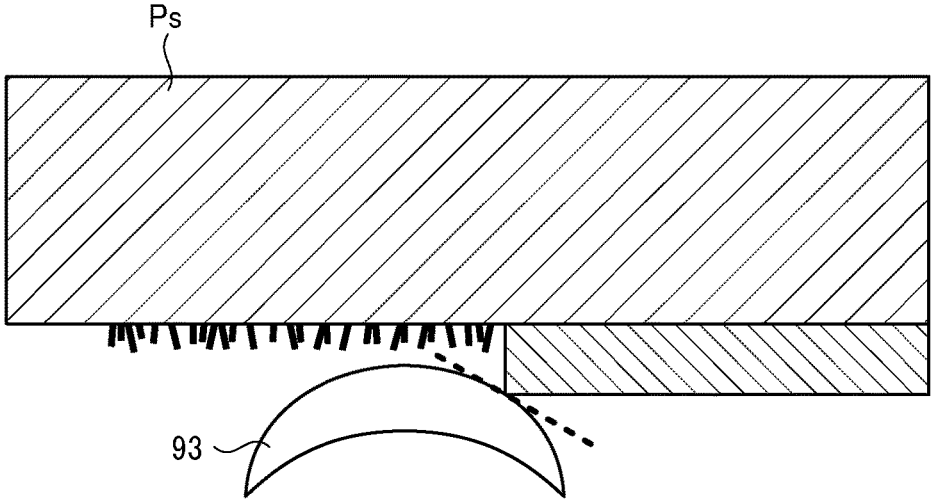
Figure 27C:
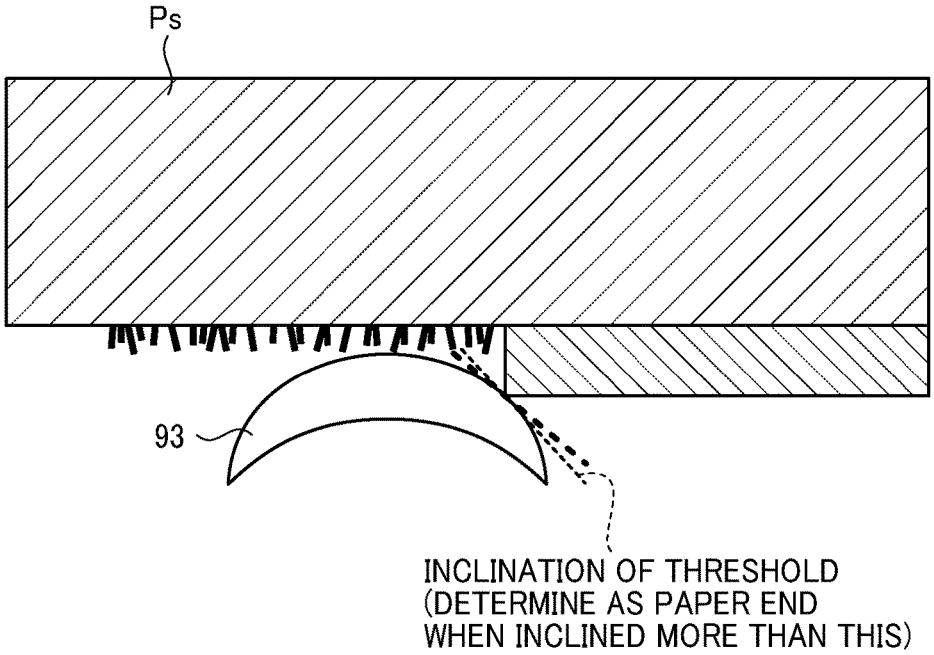
Figure 28A:
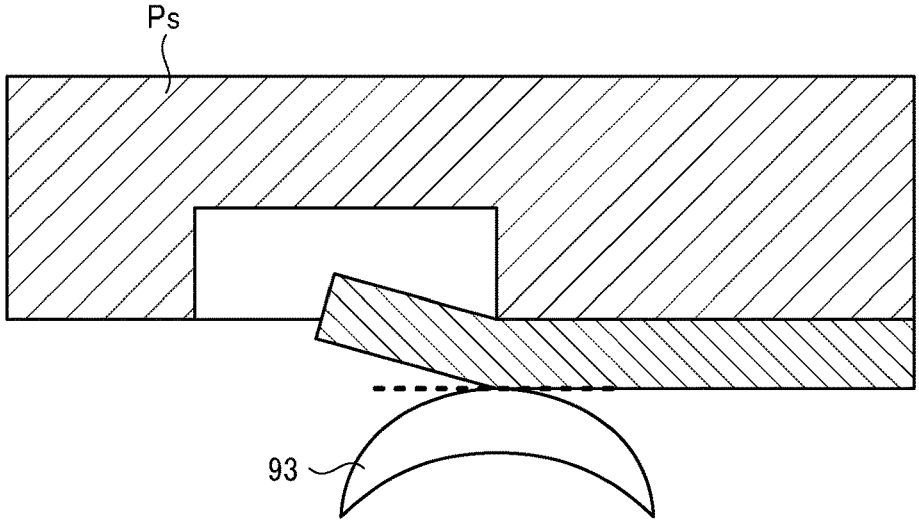
Figure 28B:
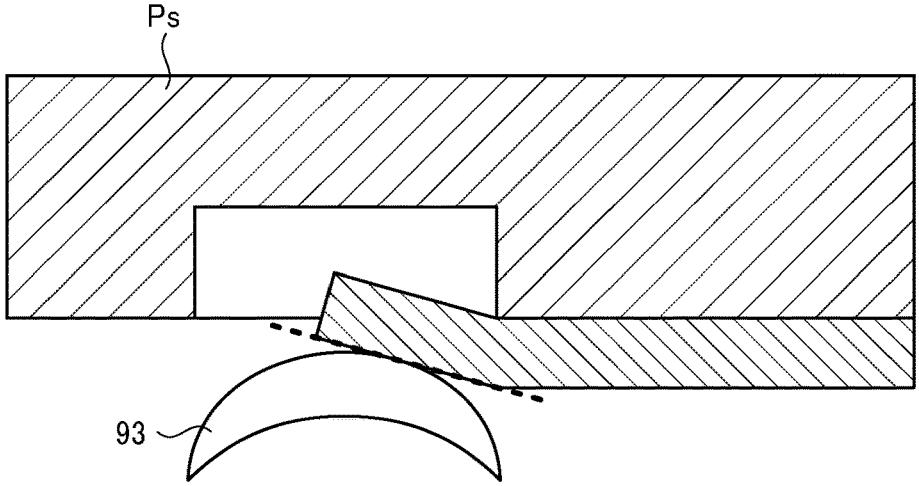
Figure 28C:
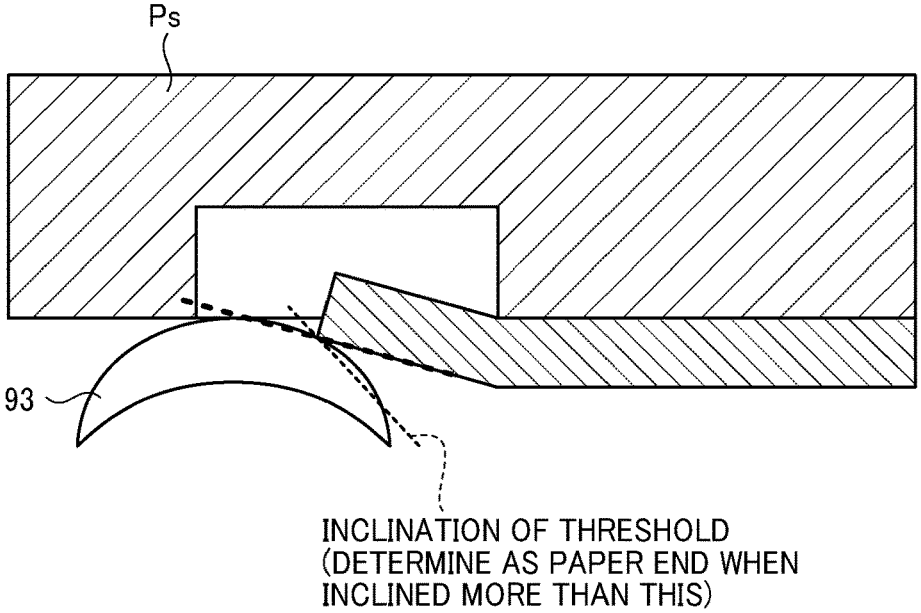
Figure 29A:
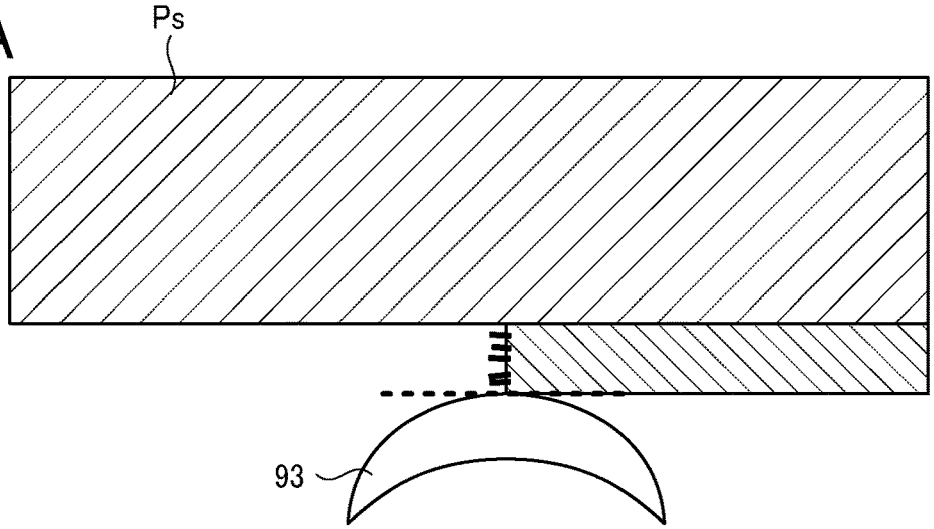
Figure 29B:
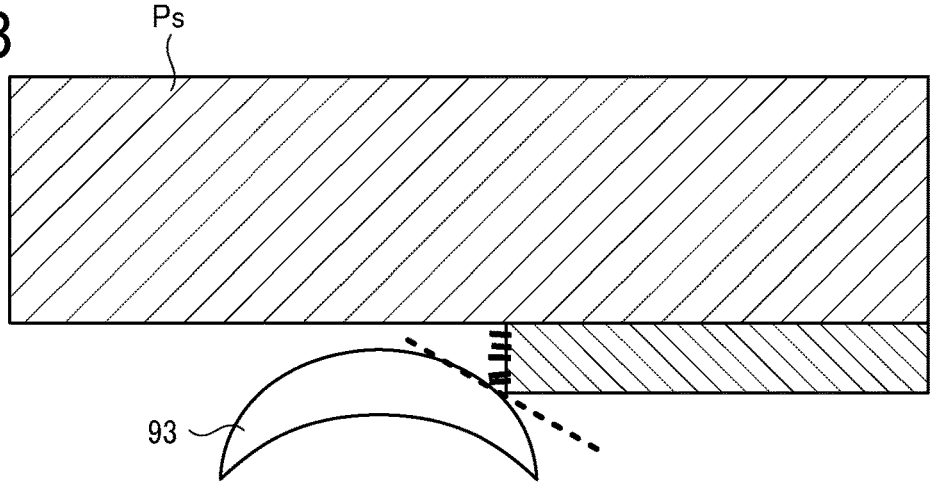
Figure 29C:
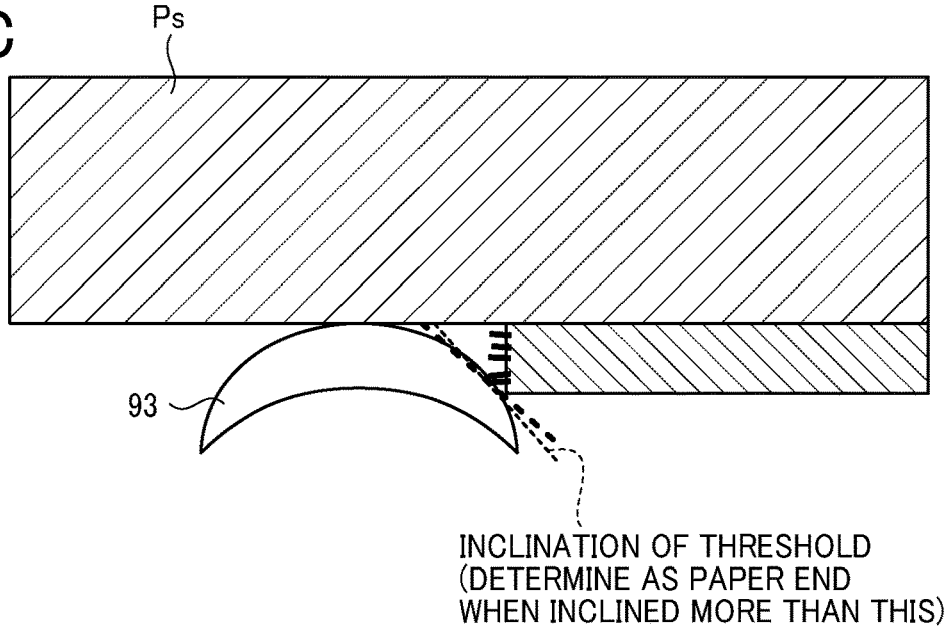
Figure 30:
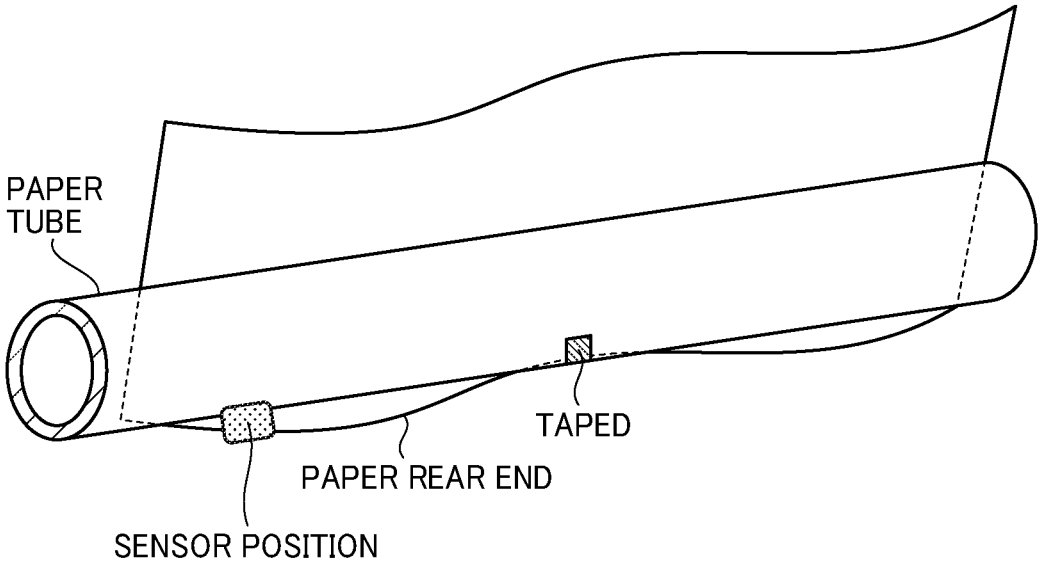
Figure 31A:
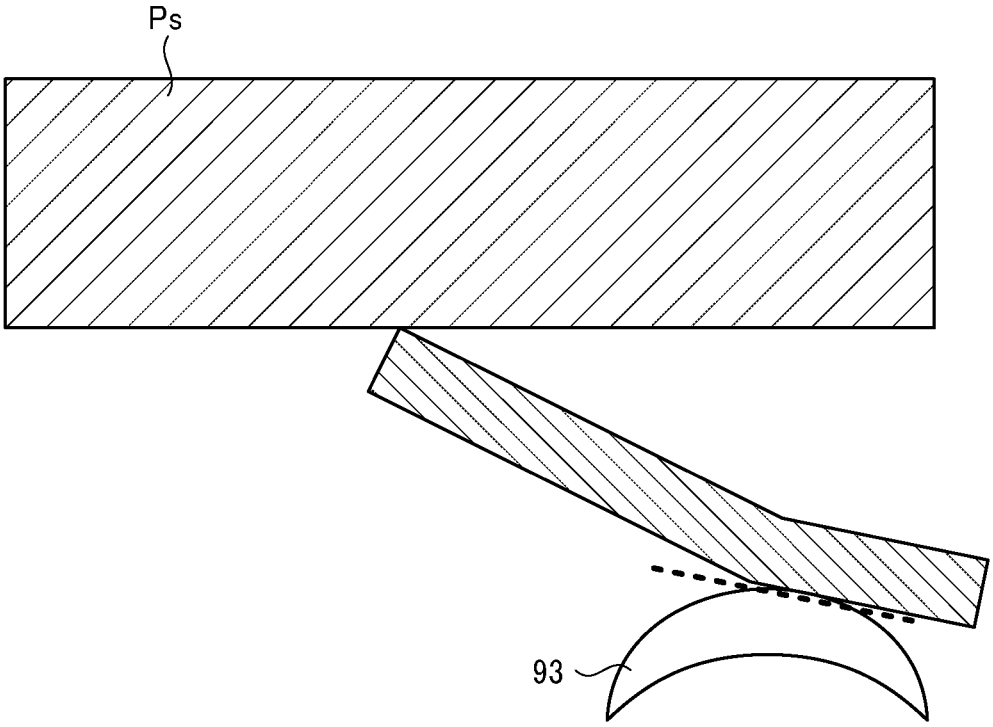
Figure 31B:
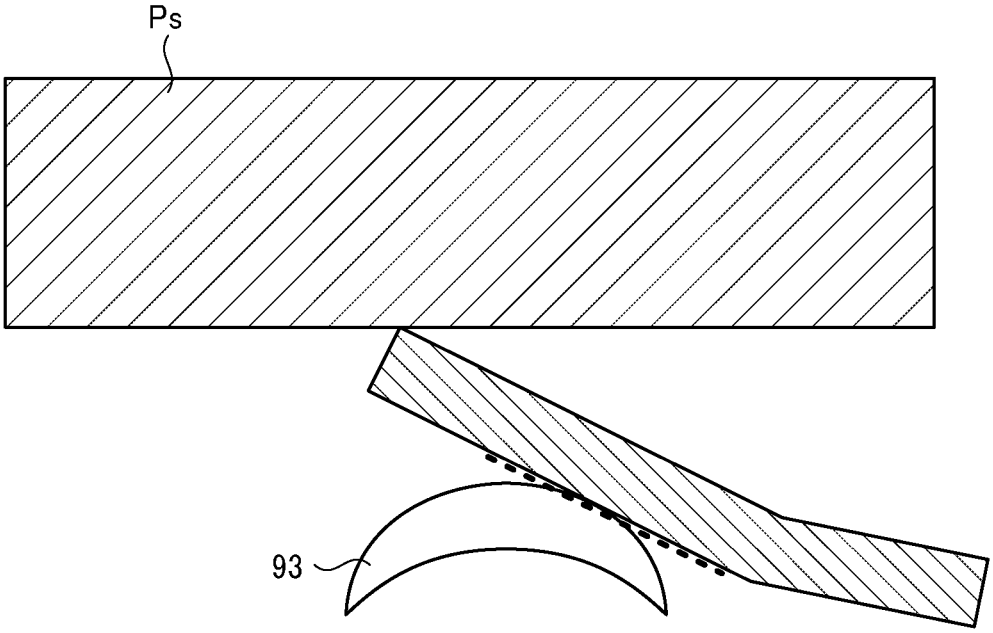
Figure 31C:
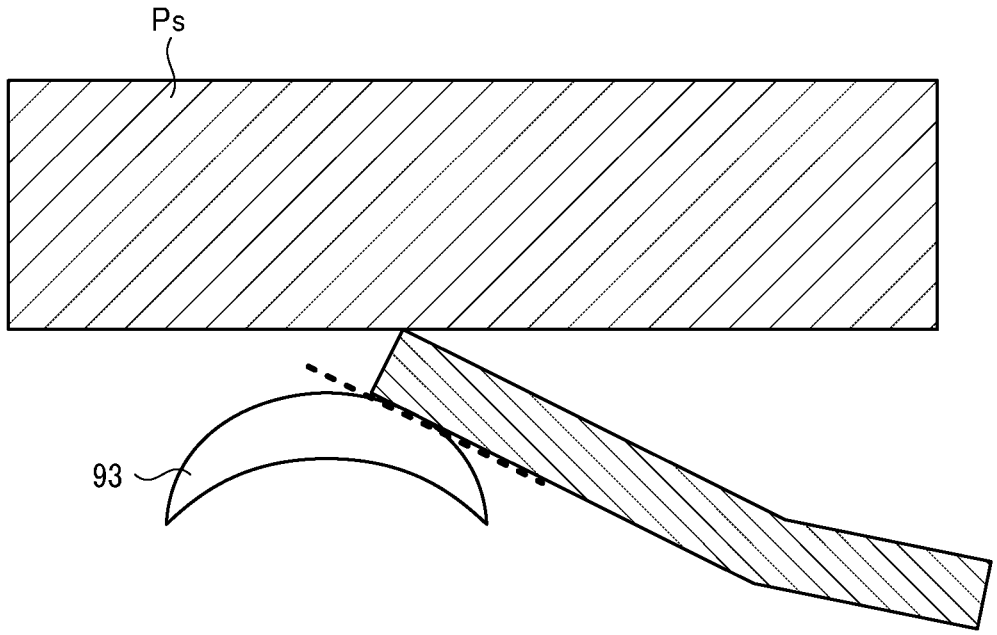
Figure 31D:
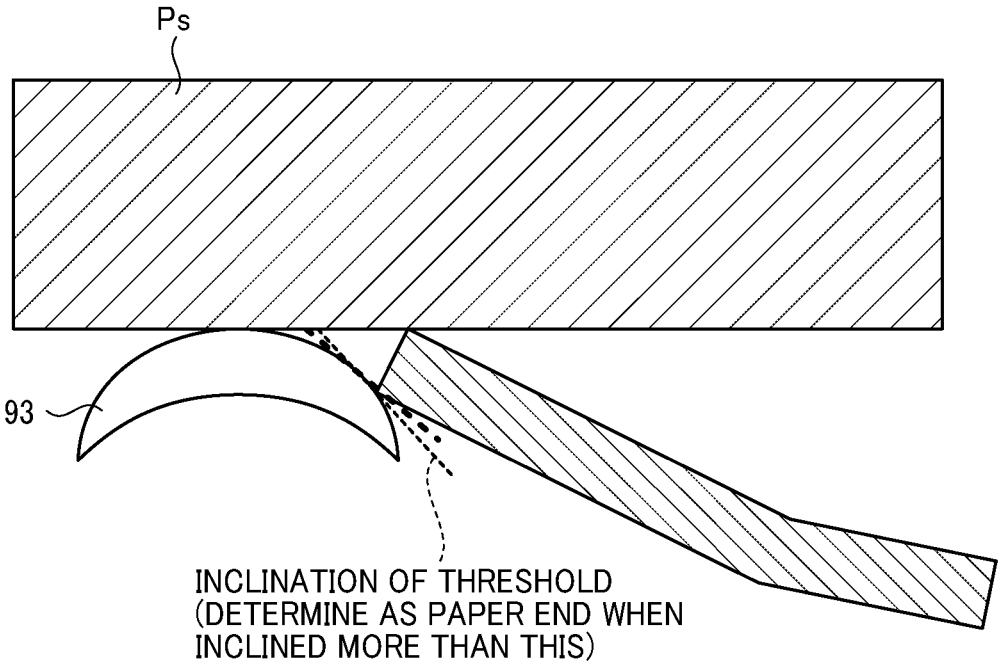
Figure 32:
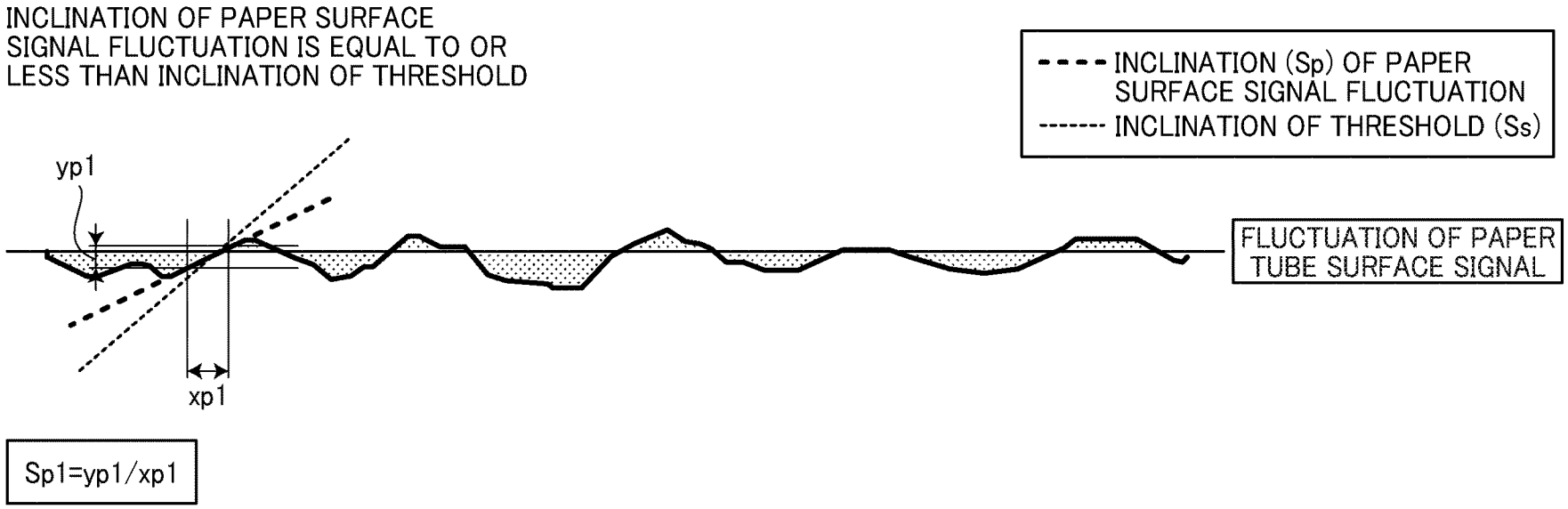
Figure 33:
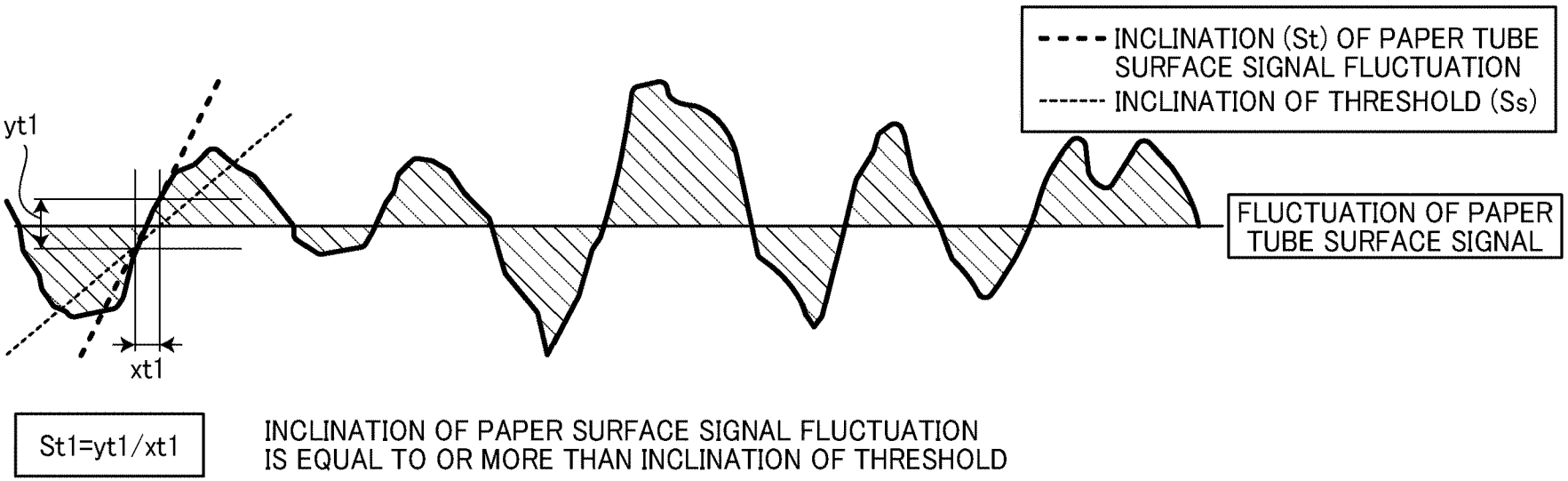
Figure 34:
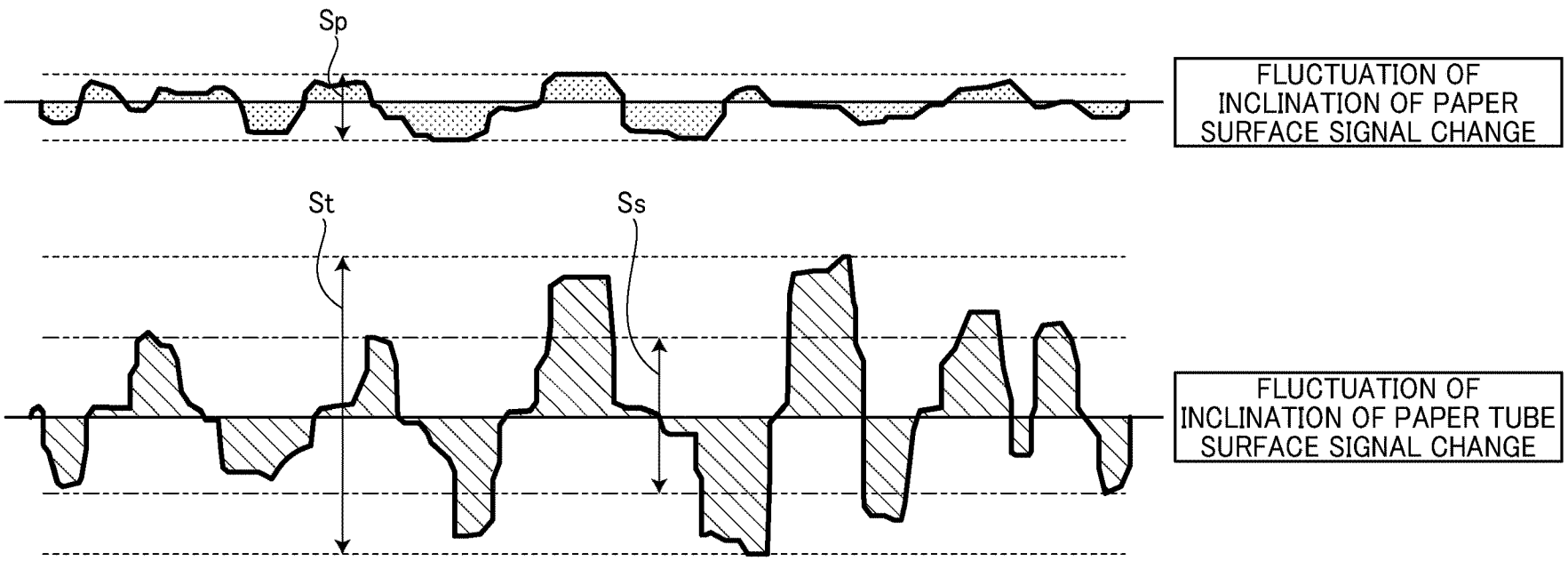
Figure 35:
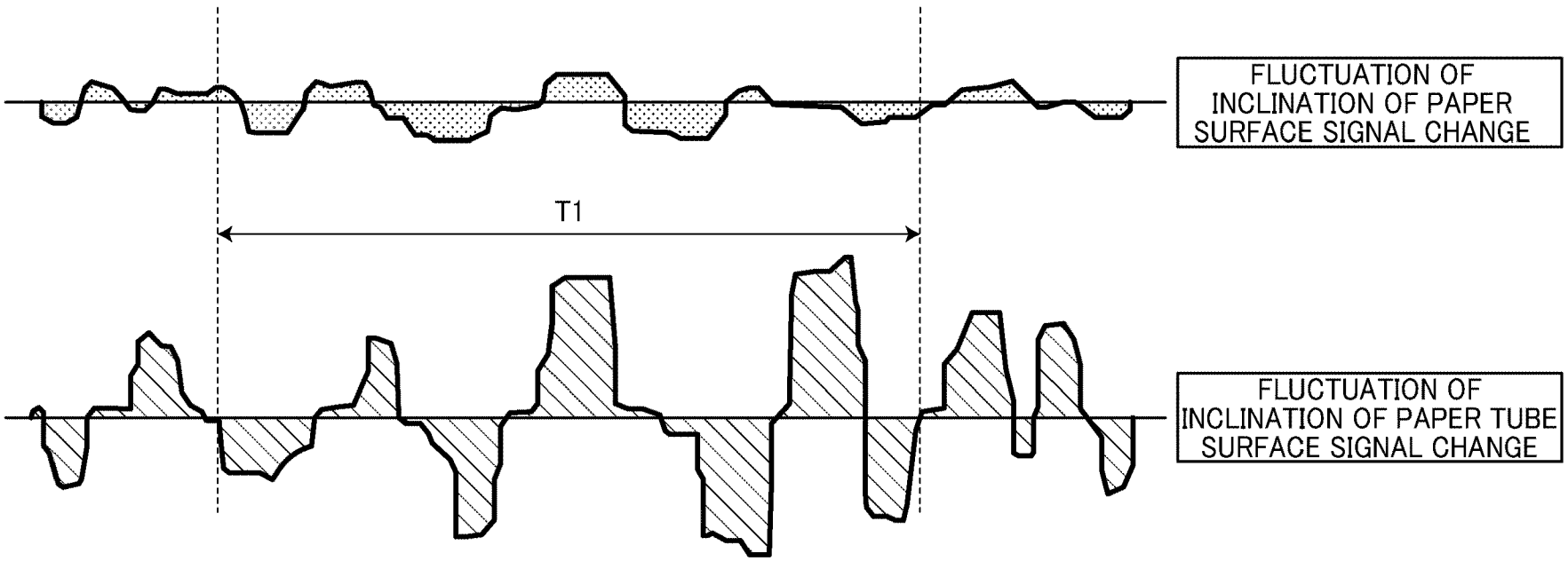
Figure 36:
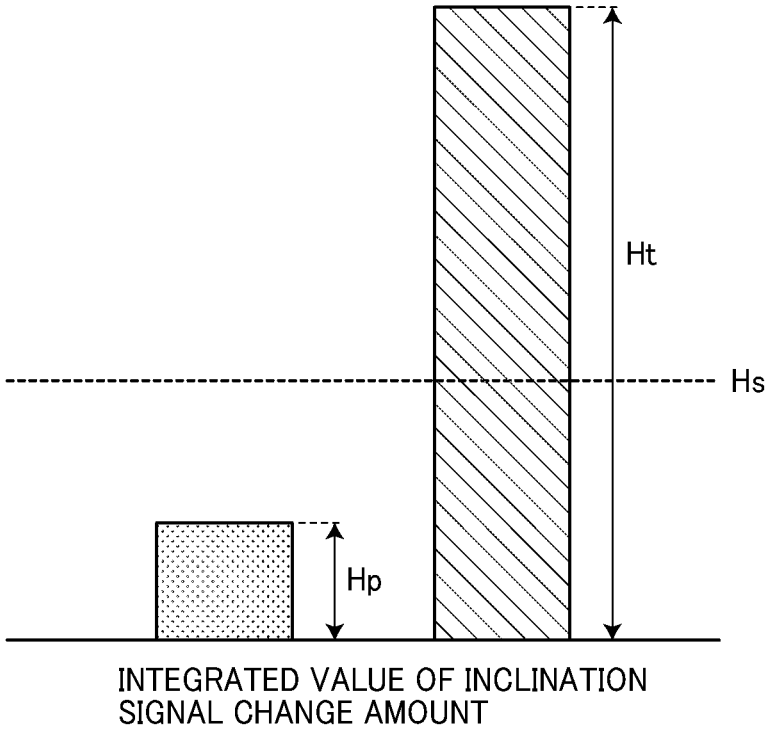
Figure 37:
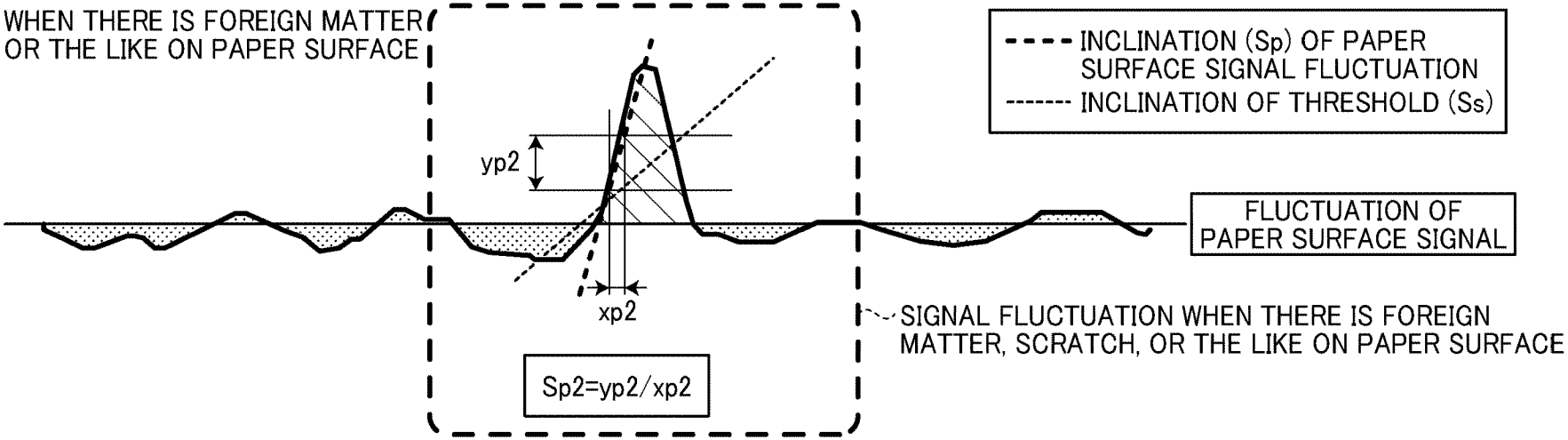
Figure 38:
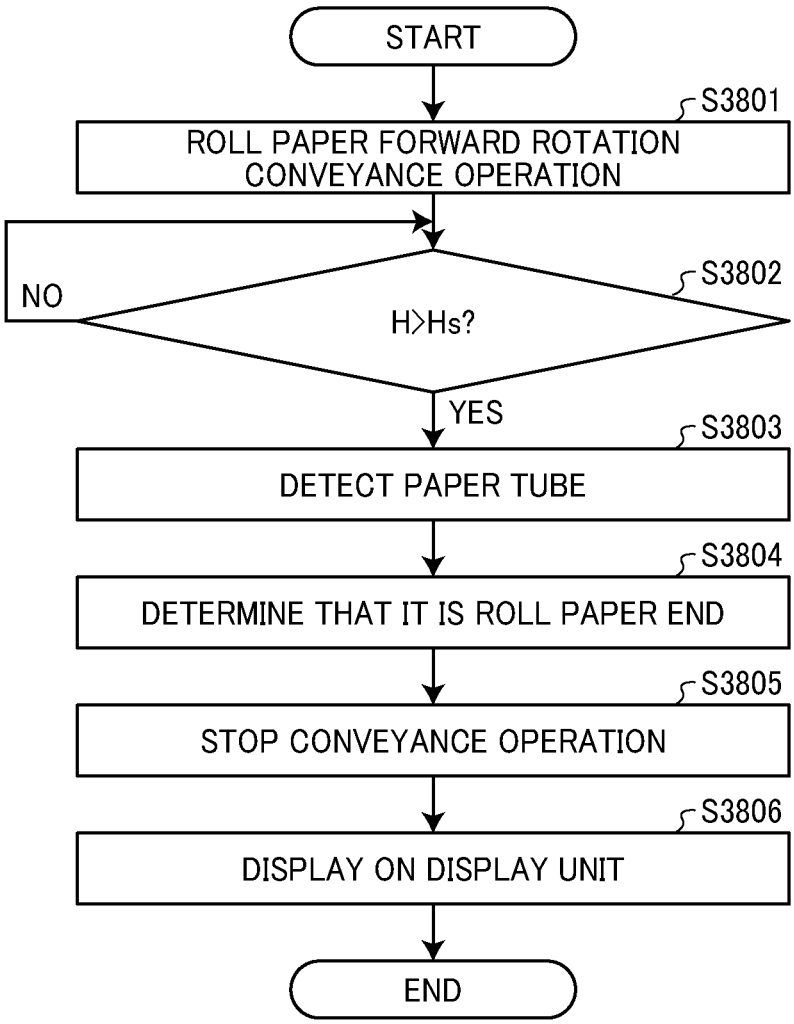
Figure 39:
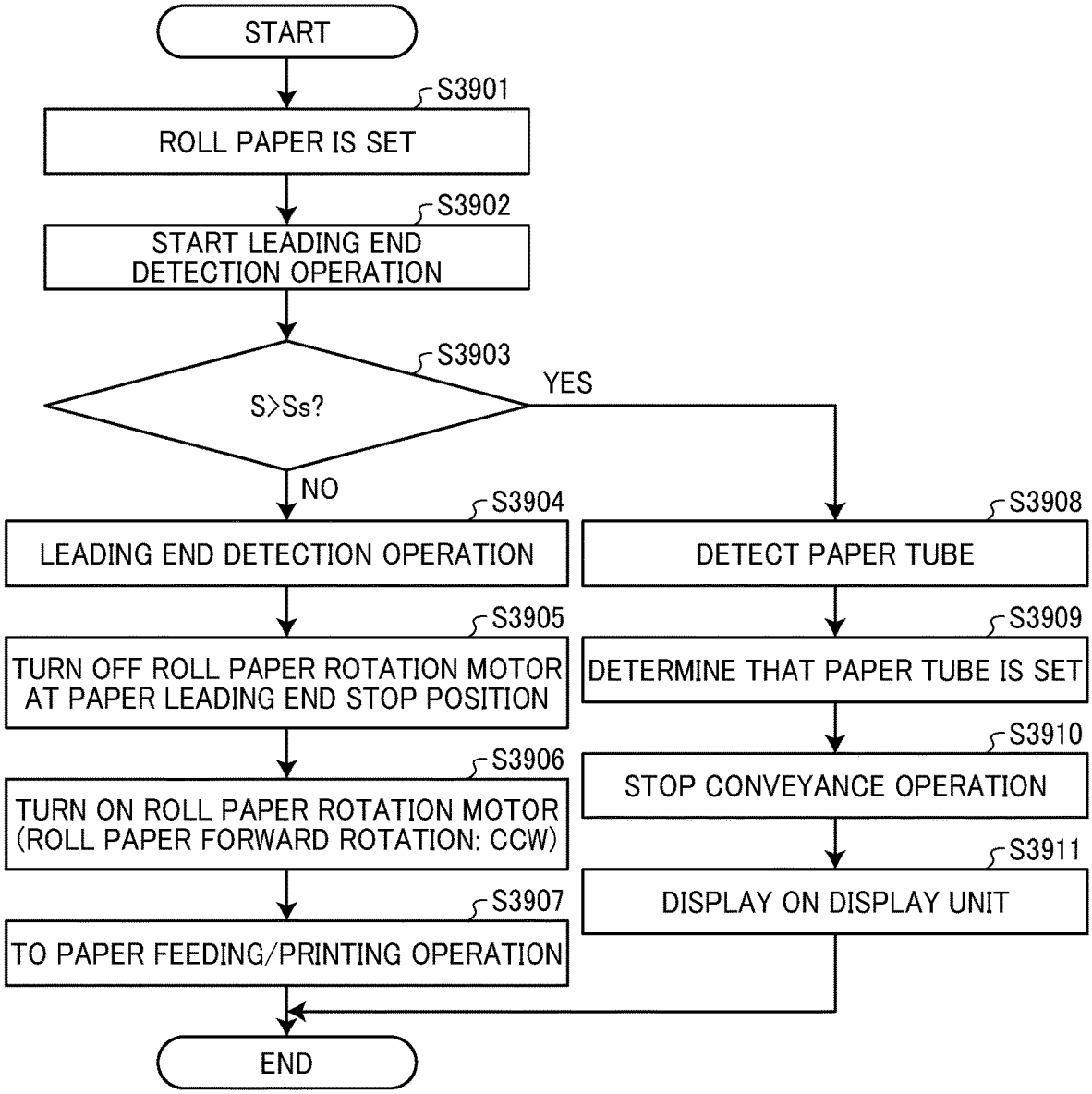

FIGS. 13A, 13B, and 13C are diagrams illustrating an example of a relationship between the roller, the sensor, and a rear end position of the roll paper and a change in the sensor signal in the paper feeding device according to the present embodiment;

FIG. 14 is a diagram illustrating an example of a relationship between the roller, the sensor, and the rear end position of the roll paper and a change in the sensor signal in the paper feeding device according to the present embodiment;

FIG. 15 is a flowchart illustrating an example of a flow of an operation of detecting the roll end in the paper feeding device according to the present embodiment;

FIG. 16 is a diagram illustrating an example of a detailed relationship between the roller, the sensor, and the rear end position of the roll paper and a change in the sensor signal in the paper feeding device according to the present embodiment;

FIG. 17 is a diagram illustrating an example of the detailed relationship between the roller, the sensor, and the rear end position of the roll paper and a change in the sensor signal in the paper feeding device according to the present embodiment;

FIG. 18 is a diagram illustrating an example of the roll paper fed by the paper feeding device according to the present embodiment;

FIG. 19 is a diagram illustrating an example of the roll paper fed by the paper feeding device according to the present embodiment;

FIG. 20 is a diagram illustrating an example of the roll paper fed by the paper feeding device according to the present embodiment;

FIG. 21 is a diagram illustrating an example of the roll paper fed by the paper feeding device according to the present embodiment;

FIG. 22 is a diagram for describing an example of an operation of detecting an end of the roll paper in the paper feeding device according to the present embodiment;

FIG. 23A is a diagram for describing the example of the operation of detecting the end of the roll paper in the paper feeding device according to the present embodiment;

FIG. 23B is a diagram for describing the example of the operation of detecting the end of the roll paper in the paper feeding device according to the present embodiment;

FIG. 23C is a diagram for describing the example of the operation of detecting the end of the roll paper in the paper feeding device according to the present embodiment;

FIG. 24 is a diagram for describing an example of an operation of detecting the end of the roll paper in the paper feeding device according to the present embodiment;

FIG. 25A is a diagram for describing the example of the operation of detecting the end of the roll paper in the paper feeding device according to the present embodiment;

FIG. 25B is a diagram for describing the example of the operation of detecting the end of the roll paper in the paper feeding device according to the present embodiment;

FIG. 25C is a diagram for describing the example of the operation of detecting the end of the roll paper in the paper feeding device according to the present embodiment;

FIG. 26 is a diagram for describing an example of an operation of detecting the end of the roll paper in the paper feeding device according to the present embodiment;

FIG. 27A is a diagram for describing the example of the operation of detecting the end of the roll paper in the paper feeding device according to the present embodiment;

FIG. 27B is a diagram for describing the example of the operation of detecting the end of the roll paper in the paper feeding device according to the present embodiment;

FIG. 27C is a diagram for describing the example of the operation of detecting the end of the roll paper in the paper feeding device according to the present embodiment;

FIG. 28A is a diagram for describing an example of an operation of detecting the end of the roll paper in the paper feeding device according to the present embodiment;

FIG. 28B is a diagram for describing the example of the operation of detecting the end of the roll paper in the paper feeding device according to the present embodiment;

FIG. 28C is a diagram for describing the example of the operation of detecting the end of the roll paper in the paper feeding device according to the present embodiment;

FIG. 29A is a diagram for describing an example of an operation of detecting the end of the roll paper in the paper feeding device according to the present embodiment;

FIG. 29B is a diagram for describing the example of the operation of detecting the end of the roll paper in the paper feeding device according to the present embodiment;

FIG. 29C is a diagram for describing the example of the operation of detecting the end of the roll paper in the paper feeding device according to the present embodiment;

FIG. 30 is a diagram for describing an example of an operation of detecting the end of the roll paper in the paper feeding device according to the present embodiment;

FIG. 31A is a diagram for describing the example of the operation of detecting the end of the roll paper in the paper feeding device according to the present embodiment;

FIG. 31B is a diagram for describing the example of the operation of detecting the end of the roll paper in the paper feeding device according to the present embodiment;

FIG. 31C is a diagram for describing the example of the operation of detecting the end of the roll paper in the paper feeding device according to the present embodiment;

FIG. 31D is a diagram for describing the example of the operation of detecting the end of the roll paper in the paper feeding device according to the present embodiment;

FIG. 32 is a schematic diagram illustrating an example of a change in a sensor signal on a surface of the roll paper in the paper feeding device according to the present embodiment;

FIG. 33 is a schematic diagram illustrating an example of a change in a sensor signal at the end of the roll paper in the paper feeding device according to the present embodiment;

FIG. 34 is a schematic diagram illustrating an example of fluctuation of an inclination of a signal change in the paper feeding device according to the present embodiment;

FIG. 35 is a diagram for describing an example of a method of comparing magnitudes of signal change inclinations in the paper feeding device according to the present embodiment;

FIG. 36 is a diagram for describing the example of the method of comparing magnitudes of signal change inclinations in the paper feeding device according to the present embodiment;

FIG. 37 is a diagram illustrating an example of an inclination of a paper surface signal fluctuation when there is a foreign matter on a part of a surface of the roll paper in the paper feeding device according to the present embodiment;

FIG. 38 is a flowchart illustrating an example of a flow of an operation of detecting the roll end of the roll paper in the paper feeding device according to the present embodiment; and FIG. 39 is a flowchart illustrating an example of a flow of a detection operation of the paper feeding device according to the present embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, a paper feeding device, a paper feeding method, a program, and an image forming apparatus according to embodiments of the present disclosure will be described in detail with reference to the accompanying drawings.

A configuration example of an image forming apparatus to which the paper feeding device according to the present embodiment is applied will be described with reference to FIGS. 1 and 2. An image forming apparatus according to an aspect of the present embodiment is an inkjet printer that performs printing on a recording medium by ejecting ink droplets corresponding to image data, but the present disclosure can also be applied to a copier, a printer, or the like of an electrophotographic system or the like that performs printing by conveying the recording medium.

Figure 1:
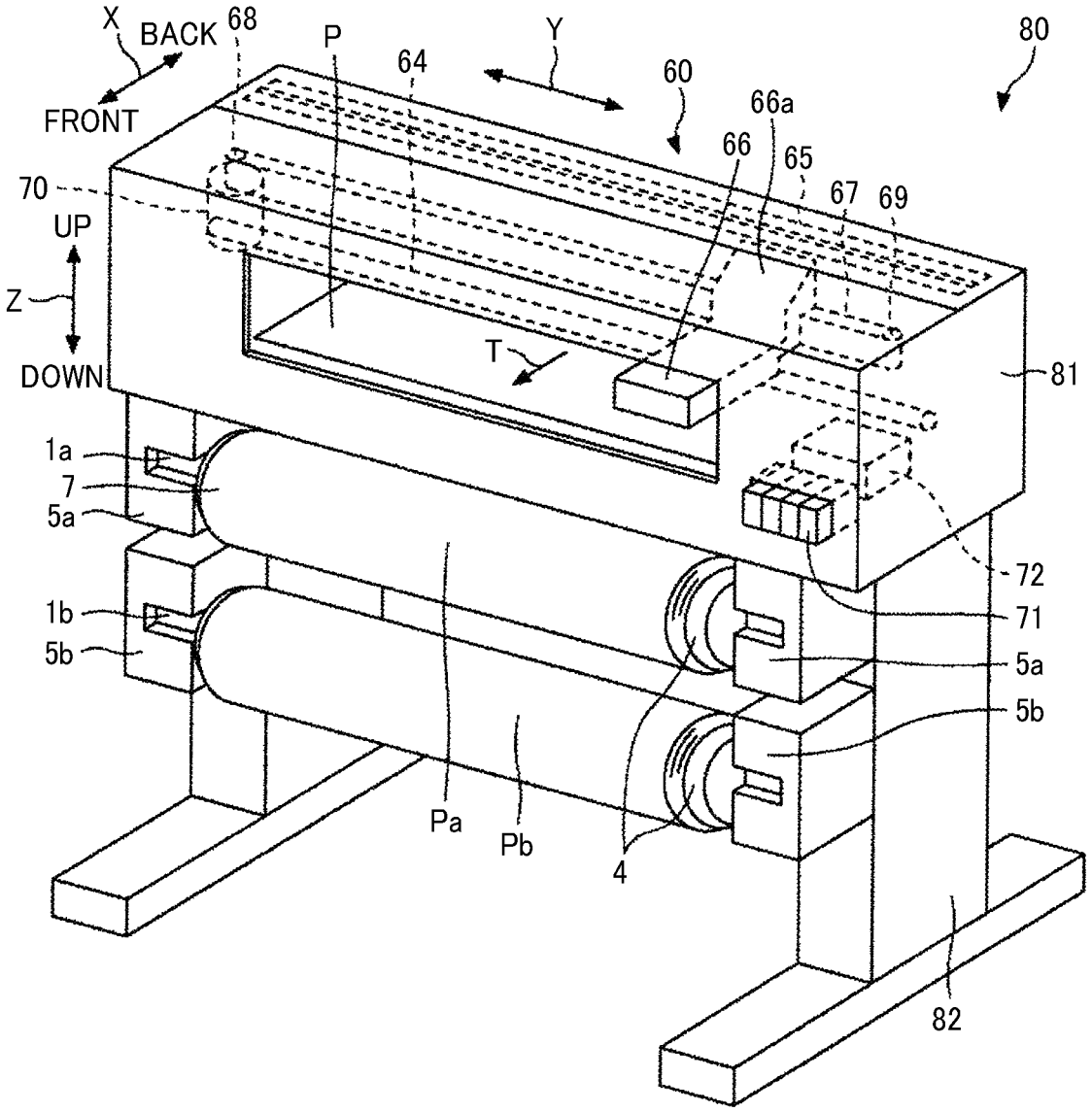
FIG. 1 is a perspective view of a schematic configuration example of an image forming apparatus according to the present embodiment.

FIG. 1 is a perspective view of a schematic configuration example of an image forming apparatus according to the present embodiment. FIG. 2 is a side cross-sectional view of the image forming apparatus according to the present embodiment, and the operation of the main part will be described together with the overall configuration of the image forming apparatus according to one embodiment. In the arrow of FIG. 1, X indicates a depth direction (front-back direction) of the image forming apparatus 80, Y indicates a width direction (main scanning direction) of the image forming apparatus 80, and Z indicates a vertical direction.

In FIG. 1, the image forming apparatus 80 is an image forming apparatus of serial type liquid ejection method (ink ejection method), and a main body housing 81 is disposed on a main body frame 82. In the image forming apparatus 80, a main guide rod 64 and a sub guide rod 65 are stretched in a main scanning direction indicated by a double-headed arrow Y in FIG. 1 in a main body housing 81. The main guide rod 64 movably supports a carriage 66, and the carriage 66 is provided with a connecting piece 66*a* that is engaged with the sub guide rod 65 to stabilize the posture of the carriage 66.

In the image forming apparatus 80, an endless timing belt 67 is disposed along the main guide rod 64, and the timing belt 67 is stretched between the driving pulley 68 and the driven pulley 69. The driving pulley 68 is rotationally driven by a main scanning motor 70, and the driven pulley 69 is disposed in a state of giving predetermined tension to the timing belt 67. The driving pulley 68 is rotationally driven by the main scanning motor 70 to rotationally move the timing belt 67 in the main scanning direction according to the rotation direction.

The carriage 66 is coupled to the timing belt 67, and the timing belt 67 is rotationally moved in the main scanning direction by the driving pulley 68, so that the carriage 66 reciprocates in the main scanning direction along the main guide rod 64.

In the image forming apparatus 80, a cartridge unit 71 and a maintenance mechanism unit 72 are detachably accommodated at end positions in the main scanning direction in the main body housing 81. In the cartridge unit 71, cartridges 73 for storing respective inks of yellow (Y), magenta (M), cyan (C), and black (K) are replaceably stored. Each cartridge of the cartridge unit 71 is connected to a recording head of a corresponding color among recording heads mounted on the carriage 66 by a pipe, and supplies ink from the cartridge unit 71 to the recording head of each color through the pipe.

The image forming apparatus 80 discharges ink onto a paper P intermittently conveyed on a platen (plate) 74 (see FIG. 2) in a sub-scanning direction (arrow X direction in FIG. 1) orthogonal to the main scanning direction while moving a carriage 66 in the main scanning direction, thereby recording an image on the paper P.

The paper P is not limited to paper, and various types of paper such as a roll-shaped film can be used. However, in the following description, for clarity of the description, the paper P being conveyed is described as a paper P, a roll state in which the paper P is wound is described as a roll paper Pr (Pa or Pb), and a core tube (a core portion or a paper tube) of the roll paper Pr is described as Ps.

Figure 2:
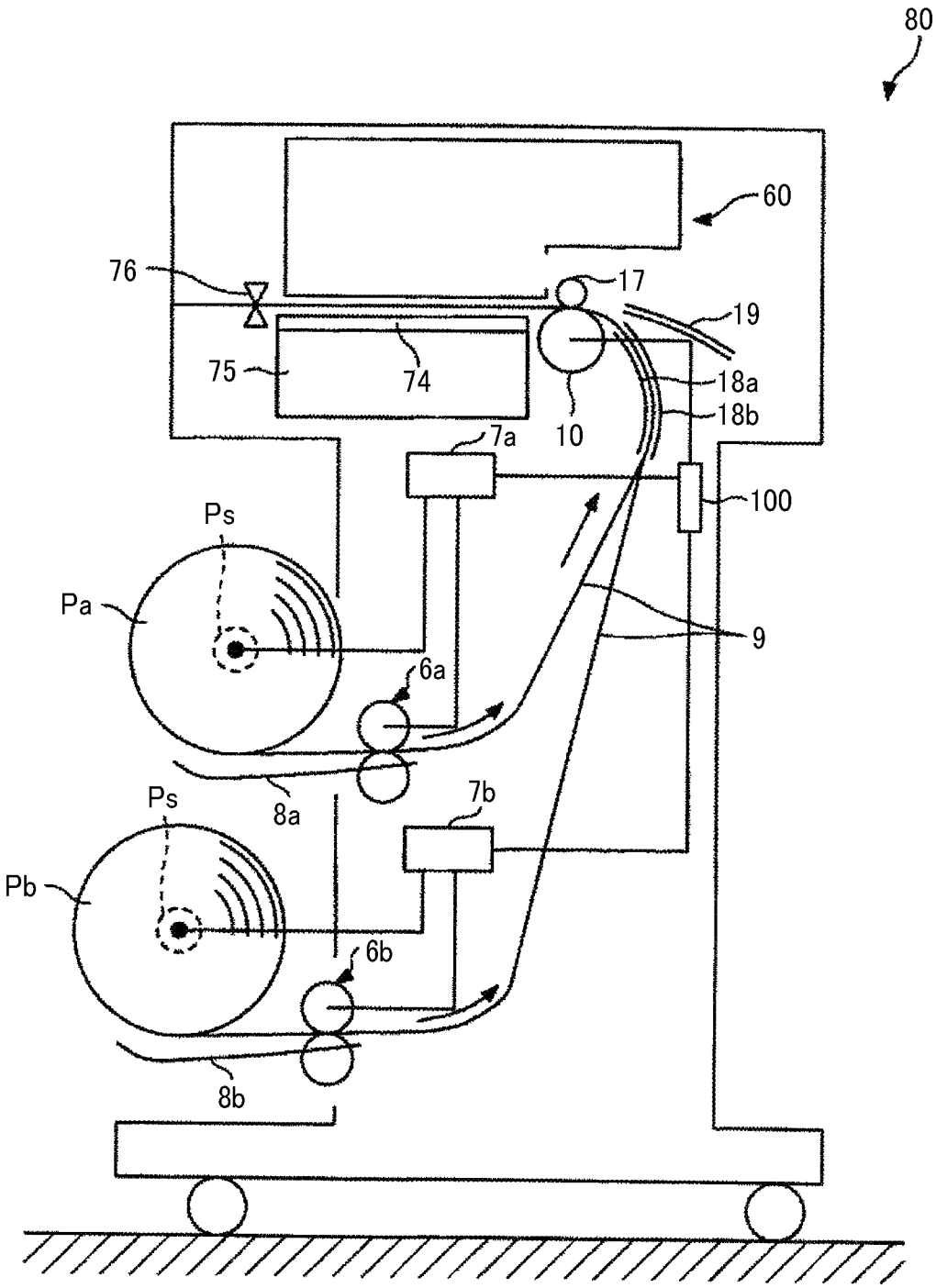
FIG. 2 is a side cross-sectional view of the image forming apparatus according to the present embodiment.

As illustrated in FIG. 2, the image forming apparatus 80 is provided with a chamber 75 in which a fan is disposed below the platen 74, and drives the fan to convey the paper P conveyed on the platen 74 while bringing the paper P into close contact with the platen 74.

The image forming apparatus 80 intermittently conveys the paper P in the sub-scanning direction, and while the conveyance of the paper P in the sub-scanning direction is stopped, while moving the carriage 66 in the main scanning direction, discharges ink from nozzle rows of the recording heads mounted on the carriage 66 onto the paper P on the platen 74 to form (record) an image on the roll-shaped paper (roll paper) Pr.

The maintenance mechanism unit 72 performs cleaning, capping, ejection of unnecessary ink, and the like of the ejection surface of the recording head to discharge unnecessary ink from the recording head and maintain the reliability of the recording head.

In the image forming apparatus 80, an encoder sheet is disposed in parallel to the timing belt 67 and the main guide rod 64 at least over a moving range of the carriage 66. The carriage 66 is provided with an encoder sensor that reads an encoder sheet. The image forming apparatus 80 controls the movement of the carriage 66 in the main scanning direction by controlling the driving of the main scanning motor 70 on the basis of the reading result of the encoder sheet by the encoder sensor.

Both ends of the paper P conveyed to an image former 60 are detected by a reflective sensor (encoder sensor, paper leading end detection sensor) mounted on the carriage 66, and at that time, the size of the paper P is detected from the main scanning direction position read by the paper leading end detection sensor.

In the image forming apparatus 80, as illustrated in FIGS. 1 and 2, two spool bearing bases 5*a* and 5*b* are provided in the vertical direction in FIGS. 1 and 2 on a main body frame 82 that supports a main body housing 81.

As indicated by arrows in FIG. 2, the paper (roll-shaped paper) P drawn out from the leading end of the roll paper Pr set on the spool bearing bases 5*a* and 5*b* is conveyed in the conveyance path 9 by the conveyance roller pairs 6*a* and 6*b*, the registration roller 10, and the registration pressure roller 17. The controller 100 controls the drive device 7 to rotate the conveyance roller pairs 6*a* and 6*b*, the registration roller 10, the registration pressure roller 17, and the like. Under the roll paper Pr (Pa and Pb), roll paper receivers 8*a* and 8*b* for preventing the roll paper Pr from falling are provided.

The paper P passes through the conveyance path 9 supported by the medium conveyance guide members 18*a* and 18*b*, and is conveyed onto the platen 74 in the image former 60. When an image is formed on both sides, the image is inverted by the inversion portion 19.

In the image former 60, the liquid recording head discharges droplets of respective colors onto the paper P in accordance with image data, thereby forming an image. In a forward conveyance direction ejection part for the paper P on which the image is formed, a cutter 76 extending in the sub-scanning direction (paper width direction), which is used to cut the paper P constituted by continuous paper to a predetermined length, is provided.

In order to align the leading end of the conveyed continuous paper P, the cutter 76 is fixed to a wire or a timing belt stretched between a plurality of pulleys (one of the pulleys is connected to a drive motor), and moves in the main scanning direction Y by the drive motor to cut the paper P to a predetermined length. The cut paper P is ejected to the ejection part. In FIGS. 1 and 2, the configuration example of the image forming apparatus in which the roll papers Pa and Pb can be set on the two spool bearing bases 5*a* and 5*b* is illustrated, but the image forming apparatus may include one spool bearing base. In the above description, the configurations corresponding to the two roll papers Pa and Pb have been described using identifiers a and b (for example, the spool bearing bases 5*a* and 5*b*), but the identifiers a and b are not described when no distinction is made therebetween.

Figure 3:
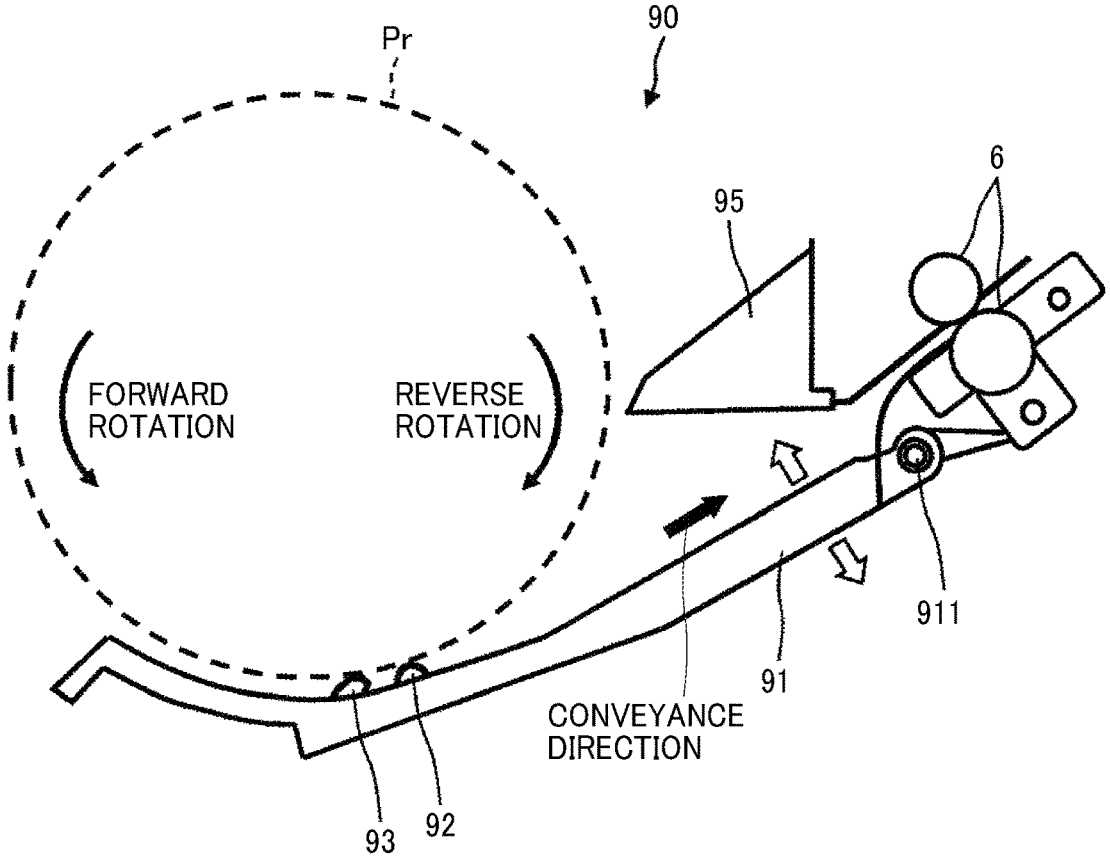
FIG. 3 is a side view illustrating a main part of a configuration example of a paper feeding device according to the present embodiment.

FIG. 3 is a side view illustrating a main part of the configuration example of the paper feeding device of the present embodiment. The paper feeding device 90 is an example of a paper feeding device that rotates the roll paper Pr forward or backward (forward and backward rotation) and feeds the roll paper Pr. In the present embodiment, the paper feeding device 90 includes at least an arm 91, a roller 92, a sensor 93, and a conveyance roller pair 6 as a conveyance unit. Preferably, the paper feeding device 90 further includes an inlet guide plate 95. In FIG. 3, the position of the roll paper Pr when the user sets the roll paper Pr in the paper feeding device 90 is indicated by a broken line. The roll paper Pr is rotatably held by a module component with respect to the center (axis) of the roll paper.

An arm (guide plate) 91 as a support of the roll paper Pr is rotatable at a rotation center 911. The arm 91 is pressed against one side of the rotation center 911 in a roll paper direction by a spring or the like. Thus, the arm 91 comes into contact with a roll paper outer diameter even when the roll paper diameter changes. A white arrow indicates the rotation direction of the arm 91. The arm 91 includes a roller 92 and a sensor 93 on the other side of the rotation center 911. Since the arm 91 is pressed in the roll paper direction, the roller 92 and the sensor 93 are supported so as to abut on a surface of the roll paper Pr.

The arm 91 serves as a guide plate that guides a conveyance direction of the paper of the roll paper Pr. Preferably, the arm 91 has a portion (end side) where the roll paper Pr is set in a shape (for example, a circular arc shape) along the outer diameter of the roll paper so that the roll paper Pr is held (not to fall or the like) when the user sets the roll paper Pr. The arm 91 also functions as the roll paper receivers 8*a* and 8*b* in FIG. 2. Since the arm 91 as a support also serves as a guide plate that guides the roll paper, the number of components can be reduced, and the cost can be suppressed. The arm 91 is an example of a support that arranges the sensor 93 and the roller 92 at positions offset from each other in a circumferential direction of the roll paper Pr with respect to substantially the center of the roll paper Pr, and supports the sensor 93 and the roller 92 so as to abut on the surface of the roll paper Pr.

The roller 92 and the sensor 93 are arranged so as to face substantially the center of the roll paper (so as to face the axial center of the roll paper) regardless of the roll paper diameter. The roller 92 is arranged at a position different from the sensor 93 in the circumferential direction of the roll paper Pr, and the roller 92 and the sensor 93 are arranged to be offset from each other in the circumferential direction. The sensor 93 is an example of a sensor having detection accuracy capable of detecting a level difference (paper thickness) at an end (leading end and rear end) of the roll paper Pr.

The inlet guide plate 95 guides the conveyance direction of the paper peeled from the roll paper Pr. In the configuration example of FIG. 3, during a paper feeding operation (during the forward rotation of the roll paper Pr), the arm 91 serving as a guide plate guides the paper on the upstream side in the conveyance direction of the paper, and the inlet guide plate 95 guides the paper on the downstream side.

Figure 4:
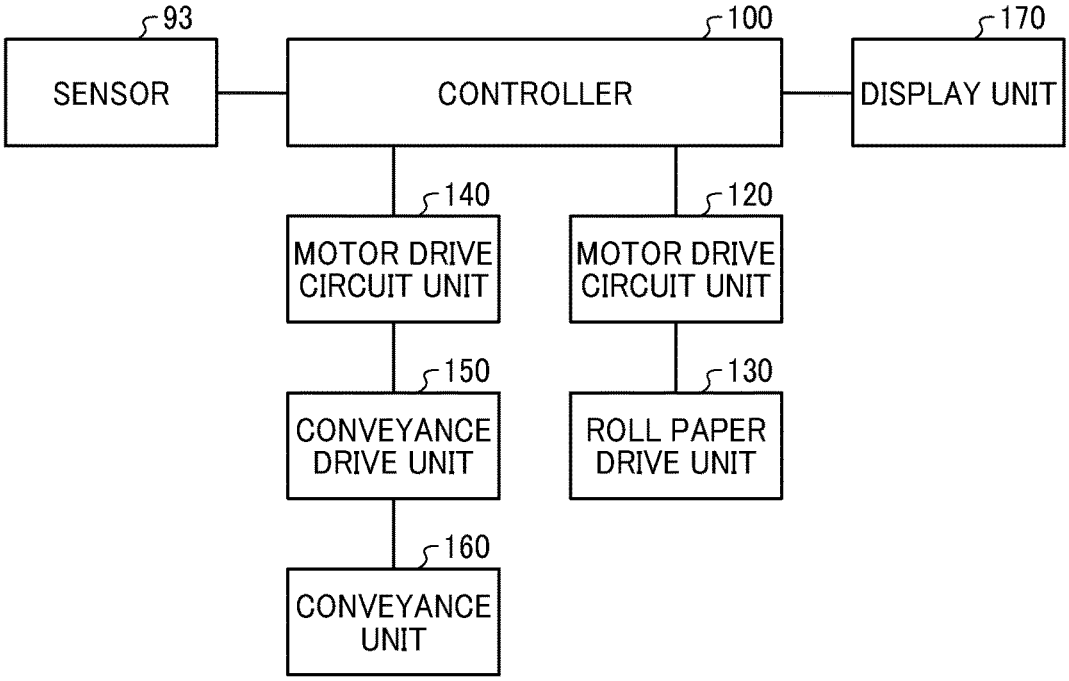
FIG. 4 is a functional block diagram illustrating a functional example of the paper feeding device according to the present embodiment.

Next, control of functions of the paper feeding device 90 will be described. FIG. 4 is a functional block diagram illustrating a functional example of the paper feeding device according to the present embodiment. The controller 100 controls the entire paper feeding device 90. In FIG. 4, an example of functional blocks in which the controller 100 controls the sensor 93, the motor drive circuit units 120 and 140, and the display unit 170 is illustrated, and other functional blocks are omitted. The function of the controller 100 may be executed by the controller 100 (see FIG. 2) that controls the entire image forming apparatus 80.

The controller 100 includes, for example, a central processing unit (CPU), a random access memory (RAM), a read only memory (ROM), and the like. The CPU executes various programs and controls the entire image forming apparatus 80 on the basis of arithmetic processing and a control program. For example, the controller 100 is an example of a controller that controls the rotation of the roll paper Pr on the basis of a sensor signal output from the sensor 93. The RAM is a volatile storage medium for reading and writing information at a high speed, and functions as a work area when the CPU executes a program. The ROM is a read-only nonvolatile storage medium in which various programs and control programs are stored.

The motor drive circuit unit 120 drives the motor under the control of the controller 100 to drive the roll paper drive unit 130. The roll paper drive unit 130 rotates the roll paper in a forward rotation direction or a reverse rotation direction. The roll paper drive unit 130 uses, for example, a roll paper rotating motor. The motor drive circuit unit 140 drives the motor under the control of the controller 100 to drive the conveyance drive unit 150. The conveyance drive unit 150 drives the conveyance unit 160. The conveyance unit 160 is a conveyance unit that conveys the roll paper Pr, and is, for example, a conveyance roller pair 6. That is, the conveyance unit 160 is an example of a conveyor that rotates the roll paper Pr forward and backward to feed the roll paper Pr. The display unit 170 is an example of a display unit that displays a paper feeding state of the roll paper Pr.

Here, an example of detection processing of the end of the roll paper Pr by the controller 100 in the paper feeding device according to the present embodiment will be described.

The controller 100 rotates the roll paper Pr in the paper feeding direction (forward rotation direction, main scanning direction), compares an inclination of a change in the sensor signal with a threshold value, and detects the paper tube Ps of the roll paper Pr. In this manner, the difference between the surface of the roll paper Pr and the surface of the paper tube Ps can be detected, so that the detection accuracy of the roll end can be improved.

The controller 100 may detect the paper tube Ps by comparing an integrated value of absolute values of inclinations of changes in the sensor signal per predetermined time with a threshold value. In this manner, even when a foreign matter or a scratch on the surface of the roll paper Pr is detected, since the sensor signals are averaged, it is resistant to erroneous detection of the paper tube Ps. For example, when a foreign matter or a scratch on the surface of the roll paper Pr is detected, there is a possibility that there is no difference or it is reversed from the magnitude of the sensor signal that has detected the surface of the paper tube Ps when compared only by the magnitude of the sensor signal. According to the present embodiment, even when a foreign matter or a scratch on the surface of the roll paper Pr is detected, the sensor signals are averaged, so that erroneous detection of the paper tube Ps can be reduced.

Here, the predetermined time may be equal to or less than the time taken for the range from the position of the sensor 93 in the paper feeding direction until the end of the roll paper Pr is separated from the paper tube Ps. In this manner, it is possible to make a determination before the rear end of the roll paper Pr enters the conveyance unit 160 after detecting the roll end (paper end) of the roll paper Pr.

The controller 100 also functions as an example of a setting unit that sets a threshold value. Thus, the threshold value can be optimized to match the roll paper Pr used by the user. In addition, the user can optimize the threshold value to match the roll paper Pr, and handling of a service or the like is not necessary.

When detecting the paper tube Ps, the controller 100 may determine that it is the roll end that is the rear end of the roll paper Pr. In this manner, since the paper tube Ps can be detected, it is possible to detect that the roll end has been reached.

After determining that the roll end of the roll paper Pr has been reached, the controller 100 may stop the paper feeding operation of the roll paper Pr. In this manner, it is possible to prevent occurrence of overload and abnormal noise on the roll paper drive unit 130. Further, it is possible to prevent paper jamming due to mixing of a stopper tape or the like at the rear end of the roll paper Pr into the conveyance unit 160.

The controller 100 may display that the roll paper Pr has run out on the display unit 170 after determining the roll end on the display unit 170. In this manner, it is possible to notify the user that the roll paper Pr has run out.

The controller 100 may determine that it is the roll end when detecting the rear end of the roll paper Pr by rotating the roll paper Pr in the paper feeding direction and detecting an inclination of a change in the sensor signal when the roll end (rear end) of the roll paper Pr passes by the sensor 93 and an inclination of a change in the sensor signal when the rear end of the roll paper Pr passes by the roller 92, or when detecting the paper tube Ps by rotating the roll paper Pr in the paper feeding direction and comparing an inclination of a change in the sensor signal with the threshold value. In this manner, by increasing the roll end determination method, it is possible to more reliably detect that the roll end has been reached by using the determination method matched with the roll paper Pr.

The controller 100 may determine that it is the roll end when detecting the rear end of the roll paper Pr by rotating the roll paper Pr in the paper feeding direction and detecting an inclination of a change in the sensor signal when the rear end of the roll paper Pr passes by the sensor 93 and an inclination of a change in the sensor signal when the rear end of the roll paper Pr passes by the roller 92, and when detecting the paper tube Ps by rotating the roll paper Pr in the paper feeding direction and comparing an inclination of a change in the sensor signal with the threshold value. In this manner, the roll end can be strictly determined, and thus it is possible to more reliably detect that the roll end has been reached.

In a leading end detection operation of the roll paper Pr after the roll paper Pr is set, when an inclination of a change in the sensor signal after the leading end detection operation is started exceeds the threshold value, the controller 100 may determine that the paper tube Ps is set. In this manner, it is possible to detect that the paper tube Ps is set with a slight operation before the error is detected after the leading end detection operation is performed.

In a case where it is determined that the paper tube Ps has been set, the controller 100 may stop the leading end detection operation and notify that the paper tube Ps has been set. In this manner, it is possible to detect that the paper tube Ps has been set with a slight operation before the error is detected after the leading end detection operation is performed, and the leading end detection operation is stopped and the user can be notified, so that the down time can be reduced.

The controller 100 may detect the leading end of the roll paper Pr by rotating the roll paper Pr in the direction opposite to the paper feeding direction and detecting an inclination of a change in the sensor signal when the leading end of the roll paper Pr passes by the roller 92 and an inclination of a change in the sensor signal when the leading end of the roll paper Pr passes by the sensor 93. In this manner, the leading end of the roll paper Pr can be directly detected using the configuration for detecting the roll end without adding a component, and the leading end of the roll paper Pr can be reliably detected without erroneous detection.

Figure 5:
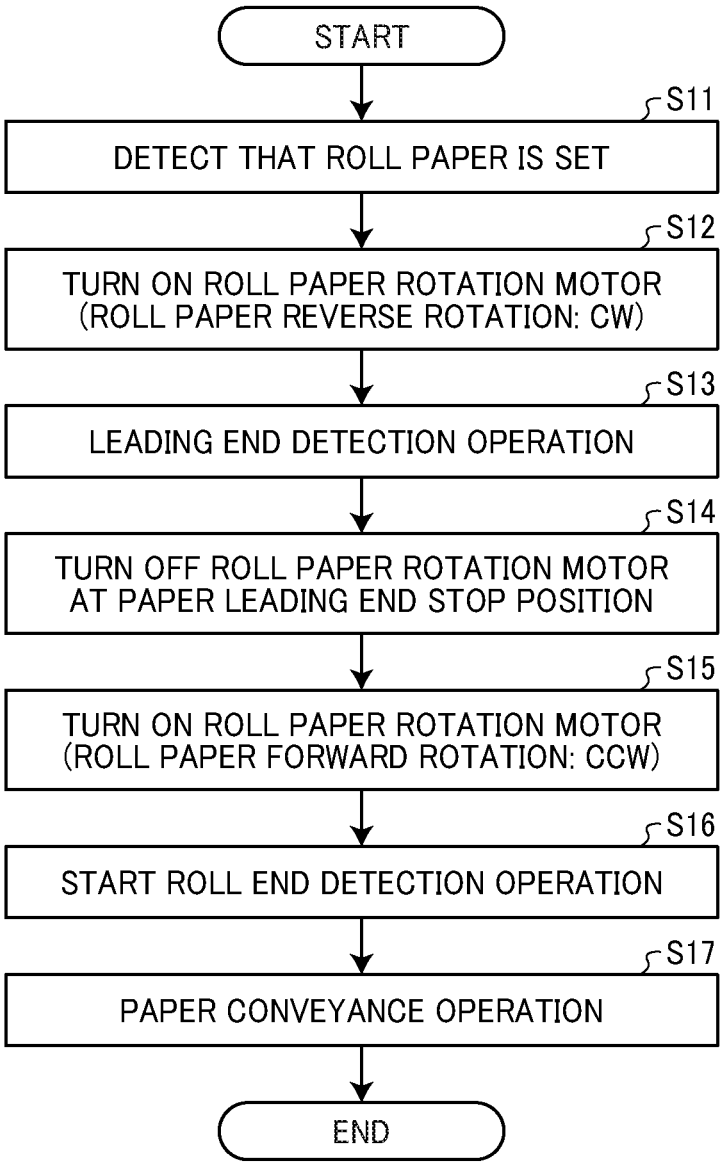
FIG. 5 is a flowchart illustrating an operation example of setting a roll paper in the paper feeding device of the present embodiment.

Next, an operation example of setting the roll paper Pr will be described. FIG. 5 is a flowchart illustrating an operation example of setting the roll paper in the paper feeding device of the present embodiment. When detecting that the roll paper Pr is set in the paper feeding device 90 (step S11), for example, when detecting based on the detection result of the sensor 93, the controller 100 controls the motor drive circuit unit 120 to cause the roll paper drive unit 130 to reverse the roll paper Pr. The roll paper rotating motor (roll paper drive unit 130) rotates the roll paper Pr in the winding direction in the reverse rotation operation (step S12), and the sensor 93 performs the leading end detection operation of detecting the leading end of the roll paper Pr (step S13). When the leading end is detected by the sensor 93, under the control of the controller 100, the motor drive circuit unit 120 stops the roll paper rotating motor at a paper leading end stop position (step S14), and sends the paper leading end of the roll paper Pr in the conveyance direction by the normal rotation operation (step S15). The sensor 93 starts the operation of detecting the rear end (roll end) of the roll paper Pr (step S16). The motor drive circuit unit 140 rotates the conveyance unit 160 to convey the leading end of the paper into the device (step S17).

Figure 6A:
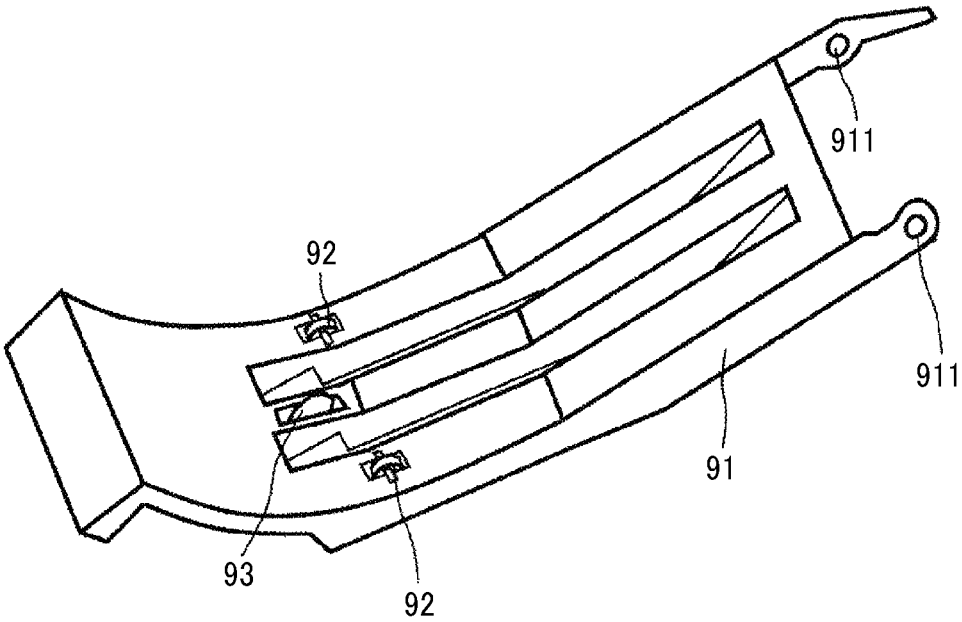
FIGS. 6A to 6C are views illustrating a configuration example of an arm of the present embodiment.
Figure 6B:
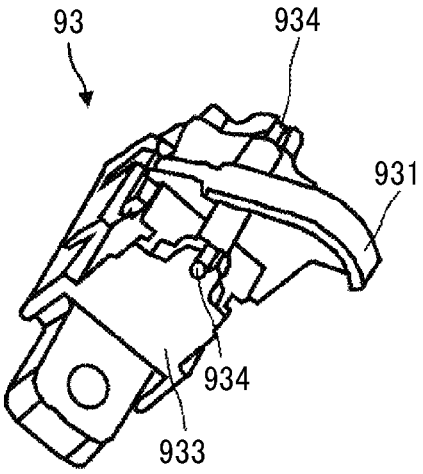
Figure 6C:
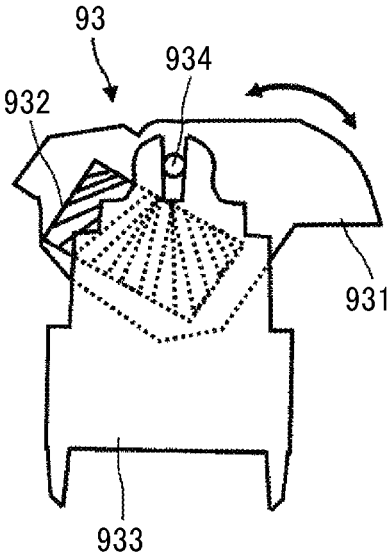

Next, a configuration example of the arm as the support and an example of the leading end detection operation will be described. FIGS. 6A to 6C are views illustrating a configuration example of the arm according to the present embodiment. FIG. 6A is a perspective view illustrating an example of the arm 91. FIG. 6B is a schematic view illustrating an external appearance of the sensor 93. FIG. 6C is a side view illustrating an example of an actuator and a side plate constituting the sensor 93. The arm 91 is disposed so that the roller 92 is on the upstream side in the paper conveyance direction and the sensor 93 is on the downstream side in the operation (reverse rotation) in which the sensor 93 detects the leading end of the roll paper.

The sensor 93 uses, for example, an encoder sensor in which the slit 932 is provided in the actuator 931, and has a resolution of about 5 m/pulse, so that it is possible to detect a level difference corresponding to the paper thickness. The actuator 931 is disposed between two side plates 933 constituting a housing of the sensor, and a shaft 934 is fitted into a bearing of the side plate 933 to rotate about the shaft 934. The actuator 931 has, for example, an asymmetric shape about the shaft 934 as illustrated in FIG. 6C. The sensor 93 includes a light emitter and a light receiver, and detects the leading end of the roll paper Pr by counting the number of light beams passing through the slit 932 of the actuator 931 from the light emitter to the light receiver (by counting the number of signal waveforms).

In the configuration example of FIGS. 6A to 6C, two rollers 92 are provided, and the sensor 93 is disposed between the two rollers 92. By disposing the sensor 93 between the rollers 92, it is possible to reliably press the floating of the leading end of the roll paper, and the leading end can be reliably detected without causing the output of the sensor 93 to be unstable due to the thickness, stiffness, and curling state of the paper. Since the roller 92 and the sensor 93 are arranged to be shifted in the circumferential direction, even if there is a partial scratch or the like, the ratio applied to both the roller and the sensor is reduced, and it is difficult to perform erroneous detection. In the following description, two or more rollers 92 are also referred to as roller portions.

Figure 7A:
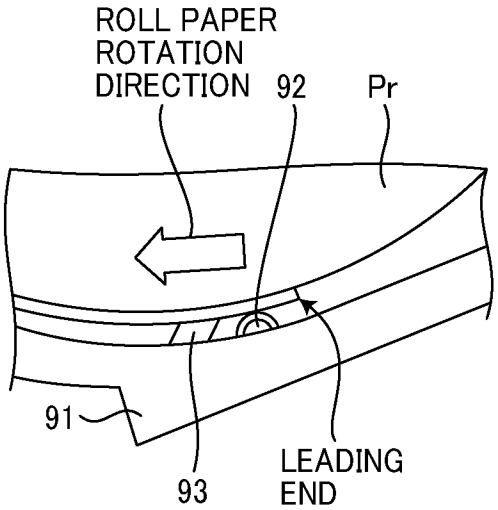
FIGS. 7A to 7C are views illustrating an operation example of detecting a leading end of a roll paper in the paper feeding device according to the present embodiment.
Figure 7B:
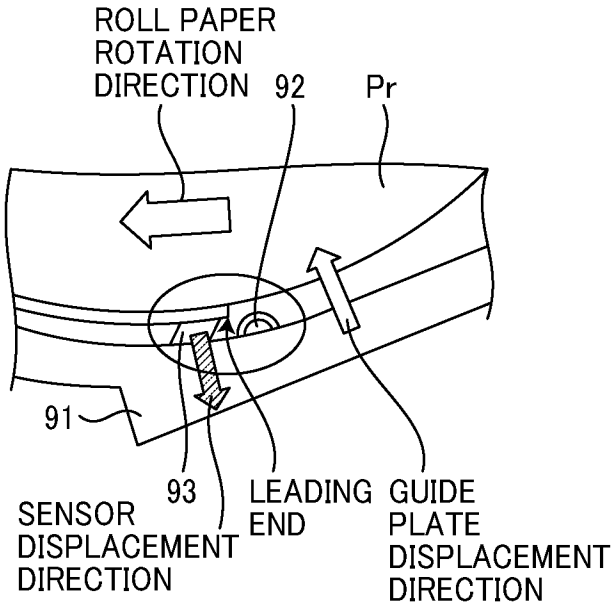
Figure 7C:
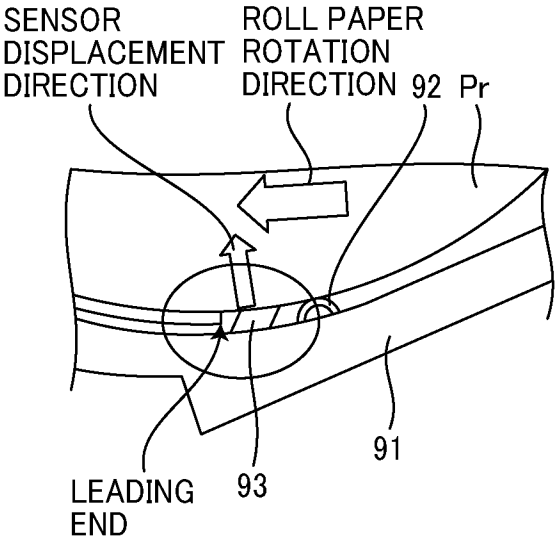

FIGS. 7A to 7C are views illustrating an operation example of detecting the leading end of the roll paper in the paper feeding device according to the present embodiment. FIGS. 7A to 7C illustrate a progress in which the leading end of the roll paper Pr passes by the roller 92 and the sensor 93. FIG. 7A illustrates a state before the leading end passes by the roller 92. FIG. 7B illustrates a state in which the leading end passes by the roller 92 and is before passing by the sensor 93. FIG. 7C illustrates a state in which the leading end passes by the sensor 93.

Since the sensor 93 and the roller 92 are arranged in the vicinity in an offset manner (offset in the circumferential direction of the roll paper Pr) and the roller 92 is located upstream of the sensor 93, the roller 92 can press the leading end of the paper until immediately before the sensor 93 detects the leading end of the paper (FIG. 7A). In this way, the sensor 93 can detect a level difference (paper thickness) on the surface of the roll paper Pr as the leading end in a state where the leading end is in close contact with the surface of the roll paper Pr. Thus, the output (detection result) of the sensor 93 does not become unstable depending on the thickness, stiffness, and curling state of the paper, and the sensor 93 can reliably detect the leading end of the roll paper Pr.

In the example of the present embodiment, the roller 92 is arranged upstream of the sensor 93, but detection can be performed even in the opposite arrangement. It is preferable to dispose the roller 92 upstream of the sensor 93 since it is possible to more reliably hold the floating of the leading end of the roll paper Pr until immediately before the detection. As illustrated in FIGS. 6A to 6C, by providing two rollers 92 and disposing the sensor 93 between the rollers, it is possible to more reliably hold the floating of the leading end of the roll paper than by one roller 92.

Figure 8:
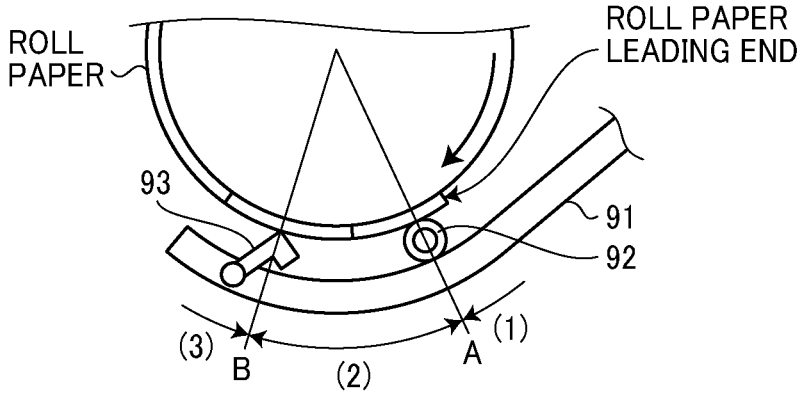
FIG. 8 is a diagram for describing an example of a relationship between leading end positions of a roller, a sensor, and a roll paper and a change in a sensor signal in the paper feeding device according to the present embodiment.
Figure 9A:
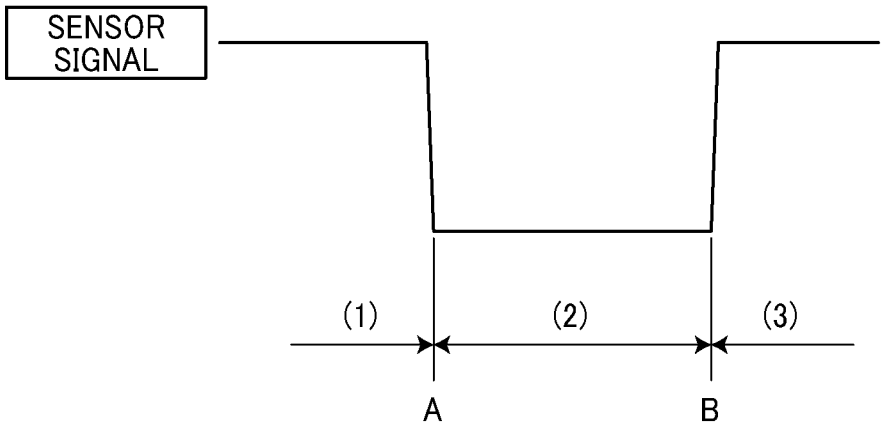
FIG. 9A is a diagram for describing the example of the relationship between the leading end positions of the roller, the sensor, and the roll paper and a change in the sensor signal in the paper feeding device according to the present embodiment.

FIGS. 8 and 9A are diagrams for describing an example of a relationship between leading end positions of a roller, a sensor, and a roll paper and a change in the sensor signal in the paper feeding device according to the present embodiment. The controller 100 reversely rotates (clockwise (CW)) the roll paper Pr and detects the sensor signal when the leading end of the roll paper Pr passes by the roller 92 (see reference sign A in FIG. 8) and the sensor signal when the leading end of the roll paper Pr subsequently passes by the sensor 93 (see reference sign B in FIG. 8), and thereby detects the leading end of the roll paper Pr. In the case of detecting the leading end of the roll paper Pr, the controller 100 reversely rotates (CW) the roll paper Pr and detects an inclination of a signal change per unit time when the leading end of the roll paper Pr passes by the roller 92 and an inclination of a signal change per unit time when the leading end of the roll paper Pr subsequently passes by the sensor 93, and thereby detects the leading end of the roll paper Pr.

Since the roller 92 and the sensor 93 are arranged to be shifted in each of the circumferential direction and the cylindrical direction, even if there is a partial scratch or the like, the ratio applied to both the roller 92 and the sensor 93 is reduced. Therefore, since the sensor signal of the sensor 93 does not have falling or rising signal waveforms as illustrated in FIG. 9A, it is difficult to erroneously detect the leading end of the roll paper Pr.

The controller 100 controls the motor drive circuit unit 120 to continue the reverse rotation after detecting the leading end of the roll paper Pr, stops the leading end of the roll paper Pr at a paper leading end stop position illustrated in FIG. 3, and shifts to a forward rotation operation (counter clockwise (CCW)). In this manner, it is possible to suppress variation in a posture of inserting the paper leading end to a guide entrance and stably convey the roll paper Pr to the downstream side regardless of the paper state (for example, curl, paper type, and paper thickness) of the roll paper Pr.

With the configuration of the present embodiment, it is possible to directly detect a level difference corresponding to the thickness of the leading end of the roll paper Pr, so that the output of the sensor 93 is not unstable depending on the thickness, stiffness, and curling state of the roll paper Pr, and detection accuracy of the leading end of the roll paper Pr can be ensured. Since the operation of setting the roll paper Pr can be automatically finished by only placing the roll paper Pr on the paper feeding device 90, it is possible to eliminate manual labor and to prevent skew and paper jam due to guide failure of the roll paper Pr.

Figure 9B:
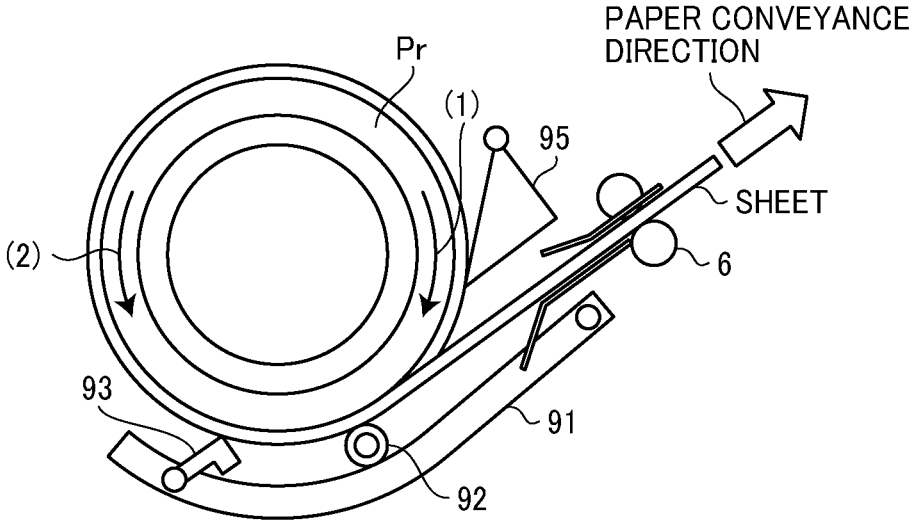
FIG. 9B is a diagram for describing an example of a configuration of automatic paper feeding of the roll paper in the paper feeding device according to the present embodiment.

FIG. 9B is a diagram for describing an example of a configuration of automatic paper feeding of the roll paper in the paper feeding device according to the present embodiment. As described above, the sensor 93 held by the arm (guide plate) 91 uses the encoder sensor in which the slit 932 is provided in the actuator 931, and has a resolution of about 5 m/pulse, so that it is possible to detect a level difference corresponding to the paper thickness (the thickness of the roll paper Pr). The roll paper Pr is rotated in the direction of winding the roll paper Pr by (1) the reverse rotation operation (CW), and the leading end detection operation is performed. After the leading end of the roll paper Pr is detected, the leading end of the roll paper Pr is sent in the conveyance direction by the forward rotation operation (CCW), conveyed to the inside of the machine (image forming apparatus 80) by the conveyance unit 160, and automatically fed.

Figure 10:
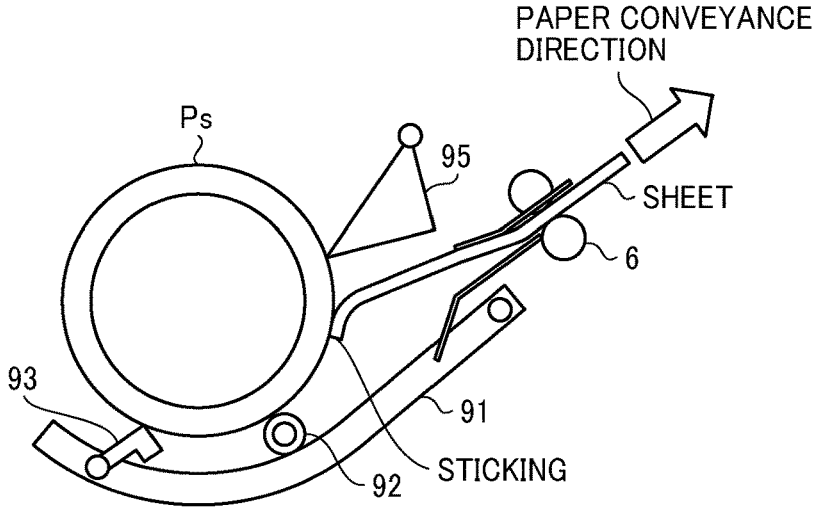
FIG. 10 is a diagram illustrating an example of a state at a time of roll end in a case where a rear end of the roll paper is glued in the paper feeding device according to the present embodiment.

FIG. 10 is a diagram illustrating an example of a state at the time of roll end in a case where the rear end of the roll paper is glued in the paper feeding device according to the present embodiment. At the time of roll end of the roll paper Pr, since the roll paper Pr is conveyed and driven until the roll paper Pr is pulled and it is determined that paper jam occurs, a large load is applied to the drive unit (conveyance drive unit 150), and abnormal noise is generated in some cases. At this time, only a paper jam error is displayed on the main body of the image forming apparatus 80, and it is not possible to immediately recognize that the roll paper Pr has run out.

Figure 11:
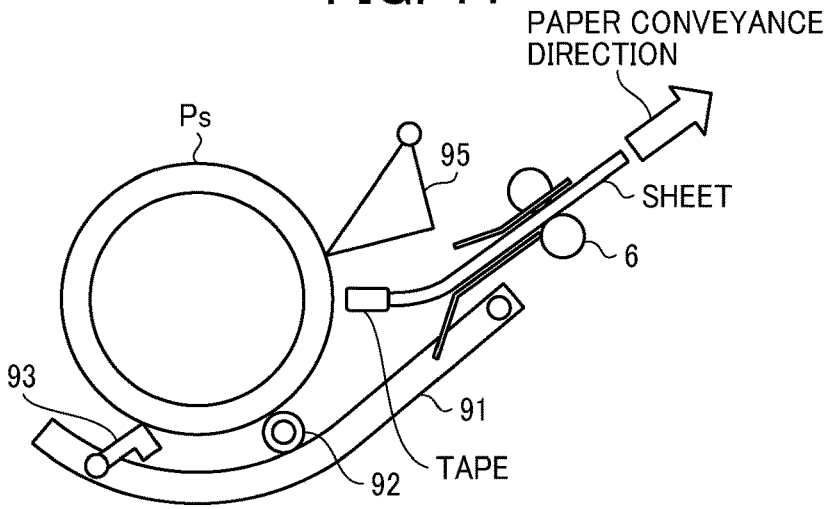
FIG. 11 is a diagram illustrating an example of a paper passing state in a case where the rear end of the roll paper is taped in the paper feeding device according to the present embodiment.

FIG. 11 is a diagram illustrating an example of a sheet passing state in a case where the rear end of the roll paper is taped in the paper feeding device according to the present embodiment. At the time of roll end of the roll paper Pr, unlike FIG. 10, the rear end of the roll paper Pr is separated from the paper tube Ps and conveyed as it is. Since the rear end of the roll paper Pr is separated from the paper tube Ps, the display of paper jam does not appear at this time, but if a tape or the like remains at the rear end of the roll paper Pr, the tape or the like sticks inside the image forming apparatus 80, which causes paper jam.

Figure 12:
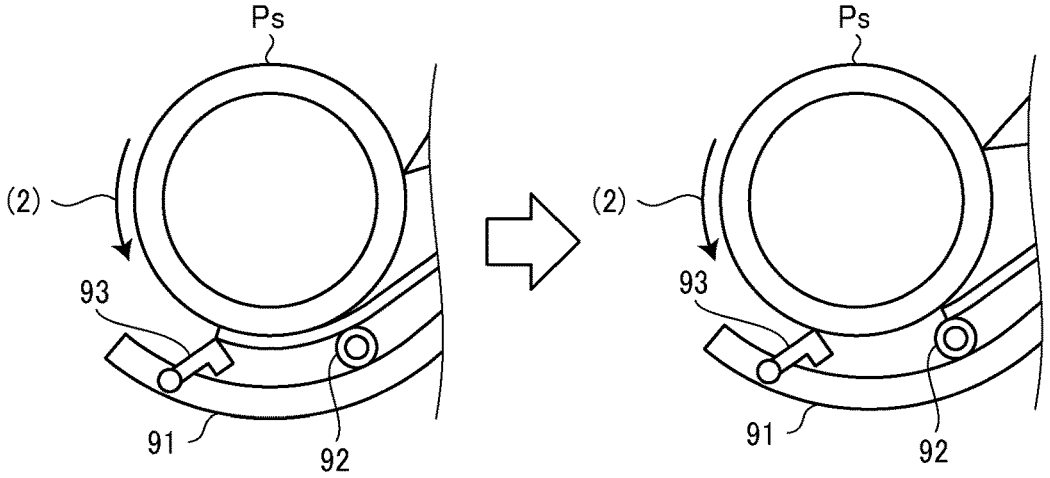
FIG. 12 is a diagram for describing an example of a paper feeding operation of the roll paper in the paper feeding device according to the present embodiment.

FIG. 12 is a diagram for describing an example of a paper feeding operation of the roll paper in the paper feeding device according to the present embodiment. In the present embodiment, in order to solve these problems, as illustrated in FIG. 12, after the leading end of the roll paper Pr is detected, an uneven state of the surface of the roll paper Pr is detected by the sensor 93 even during the forward rotation operation (CCW), and a lack of the roll paper Pr is detected by reading the level difference of the roll paper Pr generated at the time of roll end of the roll paper Pr by the paper thickness detection sensor (sensor 93).

FIGS. 13A, 13B, 13C, and 14 are diagrams illustrating an example of the relationship between the roller, the sensor, and a rear end position of the roll paper and a change in the sensor signal in the paper feeding device according to the present embodiment. Specifically, FIG. 13B illustrates an operation when the rear end of the roll paper Pr passes by the sensor 93 from the state of FIG. 13A and FIG. 13C illustrates an operation when the rear end of the roll paper Pr passes by the roller 92 next. FIG. 15 is a flowchart illustrating an example of a flow of an operation of detecting the roll end in the paper feeding device according to the present embodiment.

After the leading end of the roll paper Pr is detected, the sensor 93 detects the uneven state of the surface of the roll paper Pr during the forward rotation operation (CCW) of the roll paper Pr in the paper conveyance direction. When the rear end of the roll paper Pr passes by the sensor 93 (see FIG. 13B), the actuator 931 of the sensor 93 moves upward. Subsequently, when the rear end of the roll paper Pr passes by the roller 92 (see FIG. 13C), the guide plate (arm 91) moves upward, the actuator 931 of the sensor 93 moves downward, and the displacement of the sensor signal changes as in FIG. 14 (that is, a change in a phase opposite to a displacement of the sensor signal at the time of detecting the leading end of the roll paper Pr illustrated in FIG. 9B).

After detecting the sensor signal (R1) when the rear end of the roll paper Pr passes by the sensor 93 (see FIG. 13B) during the forward rotation operation (CCW) of the roll paper Pr in the paper conveyance direction (step S1501: Yes), the controller 231 detects the sensor signal (R2) when the rear end of the roll paper Pr passes by the roller 92 (see FIG. 13C) (step S1502: Yes). In other words, the controller 231 detects both the sensor signal (R1) and the sensor signal (R2) to detect the rear end (roll end) of the roll paper Pr (step S1503). After the detection of the roll end of the roll paper Pr, the controller 231 immediately stops the conveyance of the roll paper Pr (step S1504) and displays that the roll paper Pr has run out on the display unit 170 (for example, the operation panel) (step S1505).

In the configuration of the automatic roll paper feeding in the paper feeding device 90 according to the present embodiment, a leading end detection mechanism of the roll paper Pr for automatic roll paper feeding is used together with the detection of the roll end, so that it is not necessary to add a member to detect the roll end. Similarly to the leading end detection operation of the roll paper Pr, since the level difference corresponding to the thickness of the rear end of the roll paper Pr can be detected, the roll end can be directly detected.

FIGS. 16 and 17 are diagrams illustrating an example of a detailed relationship between the roller, the sensor, and the rear end position of the roll paper and a change in the sensor signal in the paper feeding device according to the present embodiment. In the present embodiment, the controller 100 controls a change in the sensor signal from the sensor 93 by a change amount per unit time (that is, an inclination of the change in the sensor signal, hereinafter referred to as an inclination of signal change), and an end (leading end or rear end) of the roll paper Pr is detected based on the change amount.

In a case where the rear end of the roll paper Pr is detected, the sensor signal has a phase opposite to that in the case of detecting the leading end of the roll paper Pr. When the rear end of the roll paper Pr passes by the sensor 93 during rotation of the roll paper Pr in the paper conveyance direction (CCW) (see FIG. 13B), the actuator 931 of the sensor 93 moves upward. Subsequently, when the rear end of the roll paper Pr passes by the roller 92 (see FIG. 13C), the guide plate (arm 91) moves upward, and the actuator 931 of the sensor 93 moves downward. Therefore, as illustrated in FIG. 17, the sensor signal changes in a phase opposite to the displacement of the sensor signal at the time of detecting the leading end of the roll paper Pr, and the inclination of the signal change per unit time is opposite in sign.

FIGS. 18 to 21 are diagrams illustrating an example of the roll paper fed by the paper feeding device according to the present embodiment. As illustrated in FIG. 18, since the surface of the roll paper Pr is smoother than the surface of the paper tube Ps of the roll paper Pr and the inclination of the signal change on the surface of the roll paper Pr is small, the rear end of the roll paper Pr can be detected. However, depending on the type of the roll paper Pr, the state of the surface of the paper tube varies, and the rear end of the roll paper Pr cannot be detected in some cases.

For example, the paper tube Ps illustrated in FIG. 19 is obtained by attaching a black sheet to the surface of a rough paper tube, but is in a rougher state than the surface of the roll paper Pr. Further, for example, the paper tube Ps illustrated in FIG. 20 is obtained by attaching a white sheet to a rough paper tube, but glued portions overlap each other, and a level difference is formed. The surface state of the paper tube Ps illustrated in FIG. 20 is also rougher than the surface of the roll paper Pr. The paper tube Ps illustrated in FIG. 21 remains a rough paper tube, but has grooves on the surface. Further, the paper tube Ps illustrated in FIG. 21 is in a rougher state than the surface of the roll paper Pr, and includes a fibrous material.

In a case where the surface of the paper tube Ps is rough, when there is a protrusion, a recess, or the like immediately after the roll end of the roll paper Pr, the inclination of the signal change becomes small, and the roll end cannot be detected in some cases. When the actuator 931 of the sensor 93 passes by the level difference between the roll end of the roll paper Pr and the surface of the paper tube, the movement of the actuator 931 becomes smooth, and a large inclination of the signal change cannot be obtained, and the inclination of the signal change becomes small.

Therefore, in the present embodiment, in the case where the rear end of the roll paper Pr is detected, the controller 100 detects the end (rear end) of the roll paper Pr by comparing the inclination (that is, the ratio between the movement amount of the roll paper Pr and the change amount of the sensor signal) of the signal change when the actuator 931 of the sensor 93 moves at the end of the roll paper Pr with the threshold value.

FIGS. 22 and 23A to 23C are diagrams for describing an example of an operation of detecting the end of the roll paper in the paper feeding device according to the present embodiment. As illustrated in FIG. 22, even when the paper tube surface is smooth, the roll paper Pr has a section that floats by the amount of the thickness of the paper at the rear end of the roll paper Pr. Since the roll paper Pr is strongly wound around the paper tube Ps, the roll paper Pr and the paper tube Ps are in close contact with each other even when the surface of the paper tube Ps is rough.

FIGS. 23A to 23C are schematic diagrams when the rear end of the roll paper Pr passes by the actuator 931 of the sensor 93, and a dotted line in the drawings represents the inclination of the signal change. From a state where the actuator 931 is on the surface of the roll paper Pr (see FIG. 23A), as the actuator 931 passes by the middle of the end of the roll paper Pr, the inclination of the signal change gradually increases (see FIG. 23B), and when the actuator 931 reaches the paper tube Ps from the end of the roll paper Pr, the inclination of the signal change becomes equal to or more than the threshold value (see FIG. 22C). Thus, the controller 100 can detect the end of the roll paper Pr by whether or not the inclination of the signal change is equal to or more than a threshold value.

FIGS. 24 and 25A to 25C are diagrams for describing an example of an operation of detecting the end of the roll paper in the paper feeding device according to the present embodiment. As illustrated in FIG. 24, there is a case where the surface of the paper tube Ps of the roll paper Pr is rough. In this case, in the portion where the roll paper Pr starts to be wound around the paper tube Ps, the roll paper Pr is in close contact with the paper tube Ps, but before being wound around the second turn, there is a portion that cannot be in close contact with the paper tube Ps due to the thickness of the roll paper Pr. Therefore, a rough portion of the paper tube Ps appears, the inclination of the signal change cannot exceed the threshold value, and the rear end of the roll paper Pr cannot be detected in some cases.

FIGS. 25A to 25C are schematic diagrams when the actuator 931 passes by the rear end of the roll paper Pr in a case where the paper tube surface of the roll paper Pr is rough, and a dotted line in the drawings represents the inclination of the signal change. The inclination of the signal change gradually increases (see FIG. 25B) as the actuator 931 passes by the middle of the end of the roll paper Pr from a state in which the actuator 931 is on the surface of the roll paper Pr (see FIG. 25A), but even when the actuator 931 reaches the paper tube Ps from the end of the roll paper Pr, the inclination of the signal change is smaller than the threshold value in the case of the rough state of the surface of the paper tube Ps (see FIG. 25C). In this case, the controller 100 cannot detect the end of the roll paper Pr by whether or not the inclination of the signal change is equal to or more than the threshold value.

FIGS. 26 and 27A to 27C are diagrams for describing an example of an operation of detecting the end of the roll paper in the paper feeding device according to the present embodiment. As illustrated in FIG. 25A, when the surface of the paper tube of the roll paper Pr is rough and a fibrous material protrudes, a portion where the roll paper Pr starts to be wound around the paper tube is in close contact with the paper tube Ps, but a portion that cannot be in close contact with the paper tube Ps due to the thickness of the roll paper Pr occurs before the roll paper Pr is wound around the second turn. In this case, similarly, a fibrous material of the paper tube Ps comes out, the inclination of the signal change cannot exceed the threshold value, and the rear end of the roll paper Pr cannot be detected in some cases.

FIGS. 27A to 27C are schematic diagrams when the actuator 931 passes by the rear end of the roll paper Pr in a case where the paper tube surface of the roll paper Pr is rough and a fibrous material exists, and a dotted line in the drawings represents the inclination of the signal change. The inclination of the signal change gradually increases (see FIG. 27B) as the actuator 931 passes by the middle of the end of the roll paper Pr from a state in which the actuator 931 is on the surface of the roll paper Pr (see FIG. 27A), but even when the actuator 931 reaches the paper tube Ps from the end of the roll paper Pr, the inclination of the signal change is smaller than the threshold value in the case of the rough state of the surface of the paper tube Ps (see FIG. 27C). In this case, the controller 100 cannot detect the end of the roll paper Pr by whether or not the inclination of the signal change is equal to or more than the threshold value.

FIGS. 28A to 28C are diagrams for describing an example of an operation of detecting the end of the roll paper in the paper feeding device according to the present embodiment. Next, an example of a case where there is a groove-shaped recess on the surface of the paper tube of the roll paper Pr will be described. FIGS. 28A to 28C are schematic diagrams when the actuator 931 passes by the rear end of the roll paper Pr in a case where there is a groove on the surface of the paper tube of the roll paper Pr, and a dotted line in the drawings represents the inclination of the signal change.

The inclination of the signal change gradually increases (see FIG. 28B) as the actuator 931 passes by the middle of the end of the roll paper Pr from a state in which the actuator 931 is on the surface of the roll paper Pr (see FIG. 28A), but even when the actuator 931 reaches the paper tube Ps from the end of the roll paper Pr, the inclination of the signal change is smaller than the threshold value in a case where there is a groove on the surface of the paper tube Ps (see FIG. 28C). In this case, the controller 100 cannot detect the end of the roll paper Pr by whether or not the inclination of the signal change is equal to or more than the threshold value.

FIGS. 29A to 29C are diagrams for describing an example of an operation of detecting the end of the roll paper in the paper feeding device according to the present embodiment. In addition to the influence of the paper tube Ps described above, there is a case where a fluffy material protrudes due to cutting failure or the like of the rear end of the roll paper Pr. FIGS. 29A to 29C are schematic diagrams when the actuator 931 passes by the rear end of the roll paper Pr in a case where there is fluffing due to a cutting failure at the rear end of the roll paper Pr, and a dotted line in the drawings represents the inclination of the signal change.

The inclination of the signal change gradually increases (see FIG. 29B) as the actuator 931 passes by the middle of the end of the roll paper Pr from a state in which the actuator 931 is on the surface of the roll paper Pr (see FIG. 29A), but even when the actuator 931 reaches the paper tube Ps from the end of the roll paper Pr, the inclination of the signal change is smaller than the threshold value in a case where there is a groove on the surface of the paper tube Ps (see FIG. 29C). In this case, the controller 100 cannot detect the end of the roll paper Pr by whether or not the inclination of the signal change is equal to or more than the threshold value.

FIGS. 30 and 31A to 31D are diagrams for describing an example of an operation of detecting the end of the roll paper in the paper feeding device according to the present embodiment. As illustrated in FIG. 30, when the central portion of the wide roll paper Pr is taped to the paper tube Ps, the roll paper Pr may float with respect to the paper tube Ps. Then, in a case where the sensor 93 that detects the rear end of the roll paper Pr is provided at the end of the roll paper Pr, the detection is performed in a state where the roll paper Pr is floating from the paper tube Ps, and there is a possibility that the inclination of the signal change becomes small and the threshold value cannot be exceeded. When the rear end of the roll paper Pr floats, the actuator 931 of the sensor 93 rapidly changes, so that the rear end of the roll paper Pr can be detected. However, when the roll paper Pr comes into contact with the actuator 931 with R, there is a possibility that a large signal change inclination cannot be obtained when the roll paper Pr passes by the actuator 931.

Here, the sensor 93 is often provided at an end not affected by the width in order to detect the roll paper Pr having a plurality of widths by one sensor 93. In the case of the roll paper Pr in which the roll paper Pr is pressed by the roller 92 but stiffness is high when the portion not taped bends, when the roll paper Pr is in an oblique state (that is, a state of having R with respect to the paper tube) when the actuator 931 passes by the end of the roll paper Pr, the rear end of the roll paper Pr approaches the surface of the paper tube. Thus, the level difference is reduced, and a large inclination of the signal change cannot be obtained.

FIG. 32 is a schematic diagram illustrating an example of a change in the sensor signal on a surface of the roll paper in the paper feeding device according to the present embodiment. FIG. 33 is a schematic diagram illustrating an example of a change in the sensor signal at the end of the roll paper in the paper feeding device according to the present embodiment. In the present embodiment, the controller 100 detects the rear end of the roll paper Pr by detecting a difference between the roughness of the surface of the roll paper Pr and the roughness of the surface of the paper tube Ps, and thereby determines that it is the roll end.

Specifically, the controller 100 monitors the sensor signal on the surface of the roll paper Pr while the roll paper Pr is conveyed during feeding or printing. As described above, when the surface of the roll paper Pr is smooth, as illustrated in FIG. 32, an inclination Sp of the signal change of the sensor 93 (inclination of a paper surface signal fluctuation) is small. The controller 100 determines whether an inclination Sp1 of the signal change of the sensor signal per unit time exceeds a threshold value Ss. In comparison, since the surface of the paper tube of the roll paper Pr is rough, as illustrated in FIG. 33, an inclination St of the signal change of the sensor 93 (inclination of a paper tube surface signal fluctuation) greatly fluctuates. When the surface of the paper tube of the roll paper Pr is rough, an inclination St1 of the signal change of the sensor signal per unit time may exceed the threshold value Ss.

FIG. 34 is a schematic diagram illustrating an example of fluctuation in the inclination of the signal change in the paper feeding device according to the present embodiment. In the present embodiment, the controller 100 detects a change portion (level difference) between the roll paper Pr and the paper tube Ps by comparing the magnitude of the inclination of the signal change with the threshold value. Here, the threshold value Ss is an example of a threshold value for determining the roll paper Pr and the paper tube Ps. The threshold value Ss is set to be equal to or larger than the inclination of the signal change on the surface of the roll paper Pr, and the controller 100 determines that it is the roll end of the roll paper Pr when a further change portion is detected (determines that the portion of the paper tube Ps is detected).

FIGS. 35 and 36 are diagrams for describing an example of a method of comparing the magnitudes of the signal change inclinations in the paper feeding device according to the present embodiment. Specifically, FIGS. 35 and 36 are diagrams for describing an example of a method of comparing the magnitudes of the change amounts of the sensor signals per fixed time T1. In the present embodiment, the controller 100 detects the paper tube Ps by comparing an integrated value Hp of absolute values of inclinations of signal changes of the surface of the roll paper Pr with an integrated value Ht of absolute values of inclinations of signal changes of the surface of the paper tube Ps. The controller 100 provides a threshold value Hs larger than the integrated value Hp of the absolute values of the inclinations of the signal changes on the surface of the roll paper Pr, and determines that it is the paper tube Ps when the integrated value H of the absolute values of the inclinations of the signal changes on the surface of the roll paper Pr at the time of conveyance exceeds a threshold value Hs. In this manner, even when a foreign matter or a scratch on the surface of the roll paper Pr is detected, since the inclinations of the signal changes are averaged, it is resistant to erroneous detection of the paper tube Ps. When a foreign matter or a scratch of the roll paper Pr is detected, there is a possibility that there is no difference or it is reversed from the magnitude of the sensor signal that has detected the surface of the paper tube Ps, as compared with the threshold value only by the magnitude of the sensor signal as illustrated in FIG. 34.

FIG. 37 is a diagram illustrating an example of an inclination of a paper surface signal fluctuation when there is a foreign substance on a part of the surface of the roll paper in the paper feeding device according to the present embodiment. In a case where there is a foreign substance on a part of the surface of the roll paper Pr, the fluctuation of the entire sensor signal is small, but the sensor signal greatly fluctuates only when the foreign substance on the surface of the roll paper Pr is detected. Therefore, in a case where the paper tube of the roll paper Pr is detected only by the inclination of the signal change, there is a possibility that the paper tube Ps is erroneously detected. However, when an integrated value of absolute values of inclinations of signal changes within a certain time is used, since the inclinations of the signal changes are averaged, there is no possibility of erroneous detection of the paper tube Ps, and the paper tube Ps can be detected more accurately.

By making the threshold value Ss illustrated in FIG. 34 and the threshold value Hs illustrated in FIG. 36 variable, the threshold value can be optimized to match the roll paper Pr used by the user. In a case where the roughness of the surface of the roll paper Pr is different from normal, a case where the surface state of the paper tube Ps is different from normal, or the like, such as a case where the roll paper Pr to be used is special, the threshold values Ss and Hs can be set to match the state of the roll paper Pr.

Since the threshold value Ss or the threshold value Hs can be set by the user, the user himself/herself can set the threshold value. Thus, handling of a service or the like is not necessary, and the threshold value can be set when necessary. For example, threshold values of several stages are set in advance, and the values can be easily set by selecting the threshold values from the operation unit.

FIG. 38 is a flowchart illustrating an example of a flow of an operation of detecting the roll end of the roll paper in the paper feeding device according to the present embodiment. In the present embodiment, during the forward rotation operation (CCW) of the roll paper Pr (step S3801), the controller 100 determines whether or not the integrated value H of absolute values of inclinations of changes in the sensor signal of the surface at the time of conveying the roll paper Pr exceeds the threshold value Hs (step S3802), and when the integrated value H exceeds the threshold value Hs (step S3802: Yes), the controller detects the paper tube Ps (step S3803).

When the paper tube Ps is detected, the controller 100 determines that the rear end (roll end) of the roll paper Pr has passed by the sensor 93 (step S3804). Thereafter, the controller 100 stops the conveyance operation of the roll paper Pr (step S3805). From the detection of the roll end by the sensor 93 to the stop of the conveyance of the roll paper Pr, it is necessary to stop the conveyance of the roll paper Pr in the "range of sticking of the roll end to the paper tube Ps from the position of the sensor 93" illustrated in FIG. 10. When this range is exceeded, an overload or abnormal noise occurs on the conveyance drive system due to the stretching of the roll paper Pr and the paper tube, and when the rear end of the roll paper Pr is taped, a risk of paper jam due to mixing of the tape into the conveyance unit 160 occurs.

Therefore, the fixed time T1 illustrated in FIG. 35 is set to be equal to or less than the time taken for conveying the roll paper Pr in the range from the position of the sensor 93 until the roll end is separated from the paper tube Ps. Thus, after the roll end is detected, the roll end can be detected before the rear end of the roll paper Pr enters the conveyance unit 160. By displaying that the roll paper Pr has run out on the operation unit or the like or issuing a warning by sound after the conveyance of the roll paper Pr is stopped (step S3806), it is possible to notify the user that the roll paper Pr has run out, and this leads to a reduction in downtime of the paper feeding device 90.

In the present embodiment, the controller 100 can have both functions of a method of directly detecting a level difference corresponding to the paper thickness of the rear end of the roll paper Pr and a method of detecting the paper tube Ps and determining the roll end, and can select a method of detecting the roll end suitable for the roll paper Pr. By increasing the number of roll end detection methods, the roll end can be detected more reliably using the roll end detection method matched with the roll paper Pr.

In the present embodiment, the controller 100 may have both functions of a method of directly detecting a level difference corresponding to the paper thickness of the rear end of the roll paper Pr and a method of detecting the paper tube Ps and detecting the roll end, and may detect the roll end on the basis of results of both methods of detecting the roll end. That is, after detecting the roll end at the level difference corresponding to the paper thickness, the controller 100 may determine that it is in the roll end when detecting the roll end at the paper tube Ps. As described above, by strictly detecting the roll end, it is possible to more reliably detect that the roll end has been reached.

In a case where the paper tube Ps is erroneously set at the time of setting the roll paper Pr, the leading end detection operation of the roll paper Pr is started and a detection error of the leading end of the roll paper Pr occurs, and an error is displayed after the conveyance of the roll paper Pr is stopped. In this case, the time until the error is displayed is down time, and unnecessary time is taken for the user. Therefore, in the present embodiment, the controller 100 compares the inclination of the signal change after the start of the leading end detection operation of the set of the roll paper Pr with the threshold value registered in advance, and determines that the paper tube Ps is set when the inclination of the signal change exceeds the threshold value. Then, after it is determined that the paper tube Ps has been set, the leading end detection operation is stopped and the user is notified of the stop, whereby the downtime can be significantly reduced.

FIG. 39 is a flowchart illustrating an example of a flow of a detection operation of the paper feeding device according to the present embodiment. After the roll paper Pr is set (step S3901), the controller 100 starts the leading end detection operation (step S3902). After the start of the leading end detection operation, for example, the controller 100 compares the sensor signal S for ¼ rotation of the roll paper Pr with the threshold value Ss (step S3903).

When the sensor signal S does not exceed the threshold value Ss during that time (step S3903: No), the controller 100 can determine that the roll paper Pr has been set, and performs the normal leading end detection operation (step S3904). Thereafter, when the leading end of the roll paper Pr is detected, the controller 100 stops the leading end of the roll paper Pr at the stop position (step S3905), thereafter conveys the leading end of the roll paper Pr to the sheet feeder by performing the forward rotation operation (step S3906), and thereafter performs the printing operation (step S3907).

On the other hand, when the sensor signal S exceeds the threshold value Ss (step S3903: Yes), the controller 100 detects the paper tube Ps (step S3908), determines that the paper tube Ps has been set (step S3909), and stops the conveyance operation of the roll paper Pr (step S3910). Then, the controller 100 displays the fact on the display unit 170 to notify the user (step S3911). The controller 100 can also notify that the conveyance operation of the roll paper Pr has been stopped by an operation other than the display, for example, by sound or the like. Further, in the present embodiment, the controller 100 determines whether or not the paper tube Ps is set using the sensor signal S and the threshold value Ss, but may determine whether or not the paper tube Ps is set using the integral values (integrated values) Hp and Ht illustrated in FIG. 36 and the threshold value Hs.

The controller 100 rotates the roll paper Pr in the direction opposite to the direction in which the roll paper Pr is fed, and detects the inclination of the signal change of the sensor signal of the sensor 93 when the leading end of the roll paper Pr passes by the roller 92 and the inclination of the signal change when the leading end of the roll paper Pr passes by the sensor 93, thereby detecting the leading end of the roll paper Pr. In the configuration of the automatic roll paper feeding of the paper feeding device 90 according to the present embodiment, the function can be achieved without adding a component for performing the roll end by using the leading end detection mechanism of the roll paper Pr for automatic roll paper feeding together with the detection of the paper tube Ps.

By providing a paper feeding mechanism having the function in the present embodiment, it is possible to implement detection of the leading end of the roll paper Pr and detection of the roll end without adding a component.

As described above, according to the paper feeding device 90 of the present embodiment, since the difference between the surface of the roll paper Pr and the surface of the paper tube Ps can be detected, the detection accuracy of the roll end can be enhanced.

The program executed by the paper feeding device 90 of the present embodiment is provided by being incorporated in advance in a read only memory (ROM) or the like. The program executed by the paper feeding device 90 of the present embodiment may be provided by being recorded in a computer-readable recording medium such as a compact disk (CD)-ROM, a flexible disk (FD), a CD-recordable (CD-R), and a digital versatile disk (DVD) as a file in an installable format or an executable format.

The program executed by the paper feeding device 90 of the present embodiment may be stored on a computer connected to a network such as the Internet and provided by being downloaded via the network. In addition, the program executed by the paper feeding device 90 of the present embodiment may be provided or distributed via a network such as the Internet.

The program executed by the paper feeding device 90 of the present embodiment has a module configuration including the above-described units (controller 100), and as actual hardware, a processor such as a central processing unit (CPU) reads the program from the ROM and executes the program, to thereby load the units on a main storage device, and generate the controller 100 on the main storage device.

In some roll end detection techniques, for example, the rear end of a roll paper is not directly detected, which may cause erroneous detection of the roll end. Alternatively, in a case where the surface of a paper tube of a roll paper is rough, a protrusion, a recess, or the like may come immediately after the roll end and make a change in the signal output from the sensor small, thus hindering the roll end from being detected. For example, when the step portion of the roll end passes by an actuator of the sensor, the portion immediately after the roll end becomes smooth, and a large change in which the signal exceeds the threshold value may not be obtained from the sensor, and the change may become small.

In a case where the central portion of the roll paper is fixed with a tape, when the roll paper becomes long, the sensor is positioned at an end of the roll paper so as to correspond to roll paper having a plurality of widths. In that case, floating of the end of the roll paper or the like is conceivable, and the signal of the sensor may become unstable. For example, when the rear end of the roll paper floats, the actuator of the sensor rapidly changes and hence there is no disadvantage, but when the rear end of the roll paper is curved and comes into contact with the actuator of the sensor, a large change may not be obtained from the signal of the sensor and the change may become small.

However, as described above, the paper feeding device, the paper feeding method, the recording medium storing the program, and the image forming apparatus according to the above embodiments can enhance the detection accuracy of the roll end.

Note that, in the above embodiment, an example in which the image forming apparatus is a multifunction peripheral having at least two functions of a copy function, a printer function, a scanner function, and a facsimile function is described. However, the present disclosure can be applied to any image forming apparatus such as a copier, a printer, a scanner device, or a facsimile device.

Aspects of the present disclosure are, for example, as follows.

First Aspect

According to a first aspect, a paper feeding device that rotates a roll paper forward and backward to feed the roll paper includes: a roller; a sensor to detect a level difference at an end of the roll paper; a support on which the sensor and the roller are arranged at positions offset from each other in a circumferential direction of the roll paper with respect to a substantial center of the roll paper, the support supporting the sensor and the roller so as to abut on a surface of the roll paper; and a controller to control rotation of the roll paper based on a sensor signal output from the sensor. The controller causes the roll paper to rotate in a paper feeding direction and compares an inclination of a change in the sensor signal with a threshold value to detect a paper tube of the roll paper.

Second Aspect

According to a second aspect, in the paper feeding device of the first aspect, the controller compares an integrated value of absolute values of inclinations of changes in the sensor signal per predetermined time with the threshold value to detect the paper tube.

Third Aspect

According to a third aspect, in the paper feeding device of the second aspect, the predetermined time is equal to or less than a time taken for a range from a position of the sensor in the paper feeding direction until the end of the roll paper separates from the paper tube.

Fourth Aspect

According to a fourth aspect, the paper feeding device of any one of the first to third aspects further includes a setting unit that sets the threshold value.

Fifth Aspect

According to a fifth aspect, in the paper feeding device of any one of the first to fourth aspects, the controller determines that the roll paper has reached a roll end that is a rear end of the roll paper when the paper tube is detected.

Sixth Aspect

According to a sixth aspect, in the paper feeding device of the fifth aspect, the controller stops a paper feeding operation of the roll paper after determining that the roll paper has reached the roll end.

Seventh Aspect

According to a seventh aspect, the paper feeding device of the fifth aspect or the sixth aspect further includes a display unit that displays a paper feeding state of the roll paper. The controller displays that the roll paper runs out on the display unit after determining that the roll paper has reached the roll end.

Eighth Aspect

According to an eighth aspect, in the paper feeding device of the fifth aspect, the controller determines that the roll paper has reached the roll end, in response to a detection of the rear end of the roll paper by rotating the roll paper in the paper feeding direction and detecting an inclination of a change in the sensor signal when the rear end of the roll paper passes by the sensor and an inclination of a change in the sensor signal when the rear end of the roll paper passes by the roller, or in response to a detection of the paper tube by rotating the roll paper in the paper feeding direction and comparing an inclination of a change in the sensor signal and the threshold value.

Ninth Aspect

According to a ninth aspect, in the paper feeding device of the fifth aspect, the controller determines that the roll paper has reached the roll end, in response to a detection of the rear end of the roll paper by rotating the roll paper in the paper feeding direction and detecting an inclination of a change in the sensor signal when the rear end of the roll paper passes by the sensor and an inclination of a change in the sensor signal when the rear end of the roll paper passes by the roller, and a detection of the paper tube by rotating the roll paper in the paper feeding direction and comparing an inclination of a change in the sensor signal and the threshold value.

Tenth Aspect

According to a tenth aspect, in the paper feeding device of any one of the first to ninth aspects, the controller determines that the paper tube is set, when an inclination of a change in the sensor signal after a start of a leading end detection operation of the roll paper exceeds the threshold value in the leading end detection operation performed after the roll paper is set.

Eleventh Aspect

According to an eleventh aspect, in the paper feeding device of the tenth aspect, the controller stops the leading end detection operation and notifies that the paper tube has been set, when determining that the paper tube has been set.

Twelfth Aspect

According to a twelfth aspect, in the paper feeding device of any one of the first to eleventh aspects, the controller rotates the roll paper in a direction opposite to the paper feeding direction, and detects an inclination of a change in the sensor signal when a leading end of the roll paper passes by the roller and an inclination of a change in the sensor signal when the leading end of the roll paper passes by the sensor, to detect the leading end of the roll paper.

Thirteenth Aspect

According to a thirteenth aspect, a paper feeding method is to be executed by a paper feeding device including a conveyance unit to rotate a roll paper forward and backward to feed the roll paper, a roller, a sensor to detect a level difference at an end of the roll paper, and a support on which the sensor and the roller are arranged at positions offset from each other in a circumferential direction of the roll paper with respect to a substantial center of the roll paper, the support supporting the sensor and the roller so as to abut on a surface of the roll paper. The paper feeding method includes: controlling rotation of the roll paper based on a sensor signal output from the sensor; and causing the roll paper to rotate in a paper feeding direction and comparing an inclination of a change in the sensor signal with a threshold value to detect a paper tube of the roll paper.

Fourteenth Aspect

According to a fourteenth aspect, a non-transitory recording medium storing a computer-readable program causes a computer, which controls a paper feeding device, to function as a controller. The paper feeding device includes a conveyance unit to rotate a roll paper forward and backward to feed the roll paper, a roller, a sensor to detect a level difference at an end of the roll paper, and a support on which the sensor and the roller are arranged at positions offset from each other in a circumferential direction of the roll paper with respect to a substantial center of the roll paper, the support supporting the sensor and the roller so as to abut on a surface of the roll paper. The controller controls rotation of the roll paper based on a sensor signal output from the sensor. The controller causes the roll paper to rotate in a paper feeding direction and compares an inclination of a change in the sensor signal with a threshold value to detect a paper tube of the roll paper.

Fifteenth Aspect

According to a fifteenth aspect, an image forming apparatus includes the paper feeding device of any one of the first to twelfth aspects.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application-specific integrated circuits (ASICs), field-programmable gate arrays (FPGAs), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of an FPGA or ASIC.

The invention claimed is:

1. A paper feeding device for rotating a roll paper forward and backward to feed the roll paper, the paper feeding device comprising:

a roller;

a sensor to detect a level difference at an end of the roll paper;

a support on which the sensor and the roller are arranged at positions offset from each other in a circumferential direction of the roll paper with respect to a center of the roll paper, the support supporting the sensor and the roller to abut on a surface of the roll paper; and processing circuitry configured to control rotation of the roll paper based on a sensor signal output from the sensor, wherein the processing circuitry is configured to:

cause the roll paper to rotate in a paper feeding direction; and compare an inclination of a change in the sensor signal with a threshold value to detect a paper tube of the roll paper.

2. The paper feeding device according to claim 1, wherein the processing circuitry is configured to compare an integrated value of absolute values of inclinations of changes in the sensor signal per predetermined time with the threshold value to detect the paper tube.

3. The paper feeding device according to claim 2, wherein the predetermined time is equal to or less than a time taken for a range from a position of the sensor in the paper feeding direction until the end of the roll paper separates from the paper tube.

4. The paper feeding device according to claim 1, wherein the processing circuitry is configured to set the threshold value.

5. The paper feeding device according to claim 1, wherein the processing circuitry is configured to determine that the roll paper has reached a roll end that is a rear end of the roll paper when the paper tube is detected.

6. The paper feeding device according to claim 5, wherein the processing circuitry is configured to stop a paper feeding operation of the roll paper after determining that the roll paper has reached the roll end.

7. The paper feeding device according to claim 5, further comprising a display to display a paper feeding state of the roll paper, wherein the processing circuitry is configured to display that the roll paper runs out on the display after determining that the roll paper has reached the roll end.

8. The paper feeding device according to claim 5, wherein the processing circuitry is configured to determine that the roll paper has reached the roll end, in response to a detection of the rear end of the roll paper by rotating the roll paper in the paper feeding direction and detecting an inclination of a change in the sensor signal when the rear end of the roll paper passes by the sensor and an inclination of a change in the sensor signal when the rear end of the roll paper passes by the roller, or in response to a detection of the paper tube by rotating the roll paper in the paper feeding direction and comparing an inclination of a change in the sensor signal and the threshold value.

9. The paper feeding device according to claim 5, wherein the processing circuitry is configured to determine that the roll paper has reached the roll end, in response to a detection of the rear end of the roll paper by rotating the roll paper in the paper feeding direction and detecting an inclination of a change in the sensor signal when the rear end of the roll paper passes by the sensor and an inclination of a change in the sensor signal when the rear end of the roll paper passes by the roller, and a detection of the paper tube by rotating the roll paper in the paper feeding direction and comparing an inclination of a change in the sensor signal and the threshold value.

10. The paper feeding device according to claim 1, wherein the processing circuitry is configured to determine that the paper tube is set, when an inclination of a change in the sensor signal after a start of a leading end detection operation of the roll paper exceeds the threshold value in the leading end detection operation performed after the roll paper is set.

11. The paper feeding device according to claim 10, wherein the processing circuitry is configured to stop the leading end detection operation and notify that the paper tube has been set, when determining that the paper tube has been set.

12. The paper feeding device according to claim 1, wherein the processing circuitry is configured to rotate the roll paper in a direction opposite to the paper feeding direction, and detect an inclination of a change in the sensor signal when a leading end of the roll paper passes by the roller and an inclination of a change in the sensor signal when the leading end of the roll paper passes by the sensor, to detect the leading end of the roll paper.

13. An image forming apparatus, comprising the paper feeding device according to claim 1.

14. A paper feeding method to be executed by a paper feeding device including: a conveyor to rotate a roll paper forward and backward to feed the roll paper; a roller; a sensor to detect a level difference at an end of the roll paper; and a support on which the sensor and the roller are arranged at positions offset from each other in a circumferential direction of the roll paper with respect to a center of the roll paper, the support supporting the sensor and the roller to abut on a surface of the roll paper, the paper feeding method comprising:

controlling rotation of the roll paper based on a sensor signal output from the sensor; and causing the roll paper to rotate in a paper feeding direction and comparing an inclination of a change in the sensor signal with a threshold value to detect a paper tube of the roll paper.

15. A non-transitory recording medium storing program code, the program code causing a computer that controls a paper feeding device to perform a process, the paper feeding device including: a conveyor that rotates a roll paper forward and backward to feed the roll paper; a roller; a sensor to detect a level difference at an end of the roll paper; and a support on which the sensor and the roller are arranged at positions offset from each other in a circumferential direction of the roll paper with respect to a center of the roll paper, the support supporting the sensor and the roller to abut on a surface of the roll paper, the process comprising:

controlling rotation of the roll paper based on a sensor signal output from the sensor; and causing the roll paper to rotate in a paper feeding direction and comparing an inclination of a change in the sensor signal with a threshold value to detect a paper tube of the roll paper.

* * * * *